US005709647A

United States Patent [19]

Ferber

[11] Patent Number: 5,709,647

[45] Date of Patent: Jan. 20, 1998

[54] ACUPRESSURE DEVICE

[75] Inventor: Jack Richard Ferber, New York, N.Y.

[73] Assignee: FerberDent InterNational Inc., New York, N.Y.

[21] Appl. No.: 509,969

[22] Filed: Aug. 1, 1995

[51] Int. Cl.[6] ..... A61H 7/00; A61H 39/04

[52] U.S. Cl. ..... 601/134; 606/204; 606/201

[58] Field of Search ..... 606/201, 204; 601/134, 135; 602/21, 61–64

[56] References Cited

U.S. PATENT DOCUMENTS

| | | | |
|---|---|---|---|
| 3,595,225 | 7/1971 | Beeman | 606/204 |
| 4,479,495 | 10/1984 | Isaacson | 606/204 |
| 4,549,536 | 10/1985 | Varjabedian | 601/135 |
| 4,944,289 | 7/1990 | Matthews | 601/134 |
| 5,094,227 | 3/1992 | Eglauf et al. | 601/135 |
| 5,405,310 | 4/1995 | Yoo | 606/201 |
| 5,405,357 | 4/1995 | Rowe-Lanzisera et al. | 604/204 |

FOREIGN PATENT DOCUMENTS

| | | | |
|---|---|---|---|
| 2574288 | 6/1986 | France | 601/134 |
| 2680100 | 2/1993 | France | 601/134 |
| 4205052 | 8/1992 | Germany | 601/134 |
| 198910 | 10/1965 | Sweden | 602/21 |

*Primary Examiner*—Robert A. Hafer
*Assistant Examiner*—Benjamin K. Koo
*Attorney, Agent, or Firm*—Meltzer, Lippe, Goldstein, et al.

[57] ABSTRACT

An acupressure device is disclosed for stimulating an LI-4 acupressure point located on the back side of a hand within the fleshy crotch between the thumb and index finger. The acupressure device is simple to use and enables accurate positioning over the LI-4 acupressure point and simultaneous stimulation of both hands.

10 Claims, 16 Drawing Sheets

ACUPRESSURE DEVICE

FIELD OF THE INVENTION

The present invention relates to acupressure devices. More particularly, the present invention relates to an acupressure device which is placed on the fleshy crotch between the thumb and the forefinger of a hand in order to stimulate the LI-4 acupressure point.

BACKGROUND OF THE INVENTION

Acupressure, i.e., the application of pressure to specific topical locations of the body, has been used to alleviate many diverse types of pain. One such location is the LI-4 acupressure point located on the backside of a hand, deep in the fleshy crotch between the thumb and the forefinger. It has been proposed that the application of firm pressure to the LI-4 acupressure point reduces or eliminates various types of pain, such as headaches, earaches, and dental and oral pains. The specifics of such pain control is not well understood. The amount of applied pressure depends on several factors, such as, the intensity of pain and the user's tolerance for pressure. Therefore, the amount of pressure should be adjustable by the user.

Persons may manually apply pressure to their own LI-4 acupressure points and massage the backside crotch of their hand between the thumb and the forefinger. However, a self-massage only allows applying pressure to one hand at a time. Furthermore, it is tiring and not accurate. Even when a second person is massaging else's hands, often, only one hand at a time is massaged. Furthermore, such a second person may be costly or not be available during a pain attack.

It is an object of the present invention to provide an acupressure device which is easy to use and comfortable, yet applies sufficient pressure to remain attached to the hand. It is another object of the present invention to provide an acupressure device which is adjustable to fit various size hands. It is also an object of the present invention to provide an acupressure device which applies a proper pressure, at the proper location, in a dependable, controllable and a reproducible fashion to relieve pain.

SUMMARY OF THE INVENTION

These and other objects are achieved by the present invention. According to one embodiment, an acupressure device is provided with a concave spring base, an active arm and an opposing arm. The active arm and the opposing arm are separated by a gap delineated by an inner surface of the concave spring base, the active arm and the opposing arm. The acupressure device also has a pressure nodule within the gap, which is adjustably attached to the active arm. The pressure nodule has a flat side and a blunt-nosed projection which is pointed toward the opposing arm. The blunt-nosed projection is separated from the opposing arm by an opening.

The acupressure device stimulates the LI-4 acupressure point, which is located on a backside of a hand deep in the fleshy crotch between the thumb and the forefinger. This crotch is inserted between the active arm and opposing arm of the acupressure device. Preferably, the hand crotch is inserted such that the pressure nodule is on the backside of the hand. The location and pressure exerted by the pressure nodule is adjusted to properly stimulate the LI-4 acupressure point.

To make it easier to insert the hand crotch, the pressure nodule is bell-shaped and the opposing arm has an outwardly curved (i.e., concave) tip. Furthermore, the tips of both arms are rounded, to provide for smooth surfaces without any sharp edges. Alternatively, the pressure nodule has a parabolic shape.

In another embodiment of the present invention, the acupressure device has two arms pivotally attached at a fulcrum. On one side of the fulcrum, the two arms are pressure arms separated by a gap delineated by an inner surface of the pressure arms. On the opposite side of the fulcrum, the two arms are lever arms. The acupressure device has a pair of pressure nodules, each positioned on an inner tip of each pressure arm. Alternatively, the acupressure device has a single pressure nodule. A spring is located at the fulcrum. The lever arms are urged towards one another, against a compression bias of the spring to enlarge the opening separating the two pressure nodules.

In another embodiment, the acupressure device has first and second arms. Each arm is a curved sheet with an S-shaped cross section. The first and second arms are joined at a central fulcrum in a scissor configuration. For instance, each sheet can have a slot that begins at a sheet edge and extends approximately half way across the sheet perpendicularly to the S-shaped cross-section. The arms are then inserted one slot into the other and pivotally attached thereat. The first and second arms have proximal ends, on one side of the fulcrum, and distal ends, on an opposite side of the fulcrum. The distal ends are separated by an approximately cylindrical space. Two opposing clamping arms are provided, each being connected to a different one of the opposing edges of the proximal ends of the first and second arms. The clamping arms extend away from the fulcrum. Furthermore, the acupressure device has a tension adjusting device positioned within the cylindrical space. The tension adjusting device varies a separation of the distal ends to vary a separation of the proximal ends by a scissoring action of the first and second arms. Illustratively, the tension adjusting device includes opposing wedges which are each inserted into a different end of the cylindrical space. The wedges are connected by a threaded post. Rotating the post in one direction draws the tapered wedges into the cylindrical space thereby separating the distal ends. Rotating the posts the other way forces the wedges out causing a restoring spring to close the distal ends together.

In another embodiment, a first tubular spring with a C-shaped cross-section is provided. That is, the tubular spring is nearly cylindrical, with a longitudinal end-to-end gap formed therein. Protruding clamping arms are provided, each being attached to a different edge of the gap and extending away from the spring. A tension adjusting device is provided within the tubular spring for increasing the diameter of the tubular spring, thereby separating the clamping arms, against the restoration bias of the tubular spring.

In yet another embodiment of the present invention, an acupressure device has an elastic band and a pressure nodule attached thereto. The elastic band is stretchable over the hand to exert a downward force on the pressure nodule. The downward force pushes the pressure nodule toward the LI-4 acupressure point which causes stimulation thereof. Illustratively, the elastic band also exerts a first lateral force which pulls the pressure nodule toward the base of the pinkie. A second lateral force pulls the pressure nodule toward a point on a back edge of the hand opposite the thumb, between a wrist and the pinkie of the hand.

Illustratively, the elastic band may be formed by two band portions that meet, i.e., are integral, at a portion of the palm extending from the base of the thumb to the heel of the palm.

A first band portion wraps around the heel of the palm and the lower portion of the backhand near the wrist. The second band portion wraps around the palm and backhand from the base of the thumb to the pinkie. Illustratively, the second portion has a pinkie hole into which the pinkie is inserted.

The pressure nodule may have a half spherical shape or a half egg shape. Alternatively, the pressure nodule has a rectangular horizontal cross section wherein a length of the pressure nodule has an inward curve along a vertical axis which is perpendicular to the flat side of the pressure nodule.

A hand is inserted into the elastic band and the pressure nodule positioned over the LI-4 acupressure point. The three forces exerted on the pressure nodule by the elastic band provide a clamping force which stimulates the acupressure point via the pressure nodule.

DETAILED DESCRIPTION OF THE INVENTION

Figure 1A:
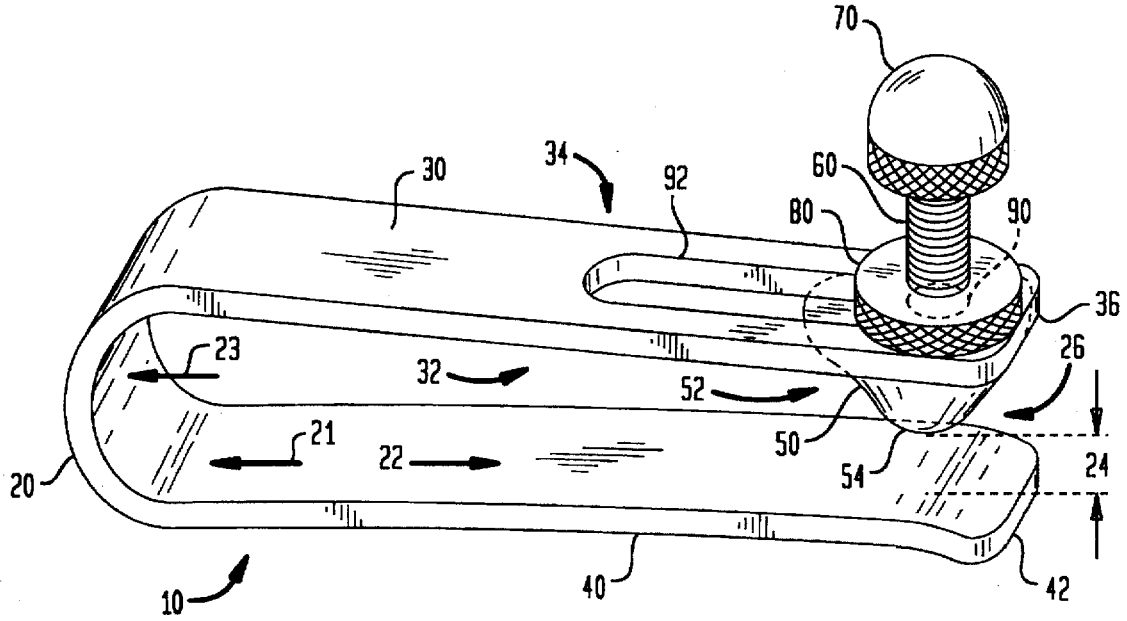
FIG. 1 a shows a three dimensional side view of an embodiment of an acupressure device according to the present invention.
FIG. 1*b* shows a two dimensional side view of the embodiment of the acupressure device shown in FIG. 1*a;*
FIG. 1*c* shows the cooperation between a duct, threaded post and pressure nodule shown in FIG. 1*a;*
FIG. 1*d* shows a cross sectional view of FIG. 1*c;*

Referring now to FIG. 1*a,* an acupressure device 10 according to an embodiment of the present invention is depicted. The acupressure device 10 includes a concave spring base 20 having an active arm 30, an opposing arm 40 and an open end 26. For example, the concave spring base 20 is approximately U-shaped and may be made of metal, plastic or metal covered with plastic. The active arm 30 and the opposing arm 40 are separated by a gap 22. The gap 22 is delineated by an inner surface of the concave spring base 20, the active arm 30 and the opposing arm 40.

A pressure nodule 50 is positioned on an inner surface 32 of the active arm 30. Illustratively, the pressure nodule 50 has an inverted bell shape with a flat upper surface 52 and a projection 54 on the opposite side of the flat surface. The projection 54 is blunt-nosed for example. Alternatively, the pressure nodule 50 has a parabolic shape and the projection 54 is rounded. The projection 54 is separated from the opposing arm 40 by an opening 24 (see also FIG. 1*b*).

The flat upper surface of the pressure nodule 50 is swivelly attached to a threaded post 60 which is in turn fixedly attached to a knurled knob 70. The knurled knob 70 facilitates turning the threaded post 60. Turning the threaded post 60 causes the pressure nodule 50 to move toward or away from the opposing arm 40 thus reducing or enlarging the opening 24.

The threaded post 60 goes through a threaded bore defined by a duct 90 located in a hole of the active arm 30. In an illustrative embodiment, the duct 90 is slidably located within a positioning slot 92 that extends through the active arm 30 so that the duct 90 may be moved along the positioning slot 92.

Figure 1B:
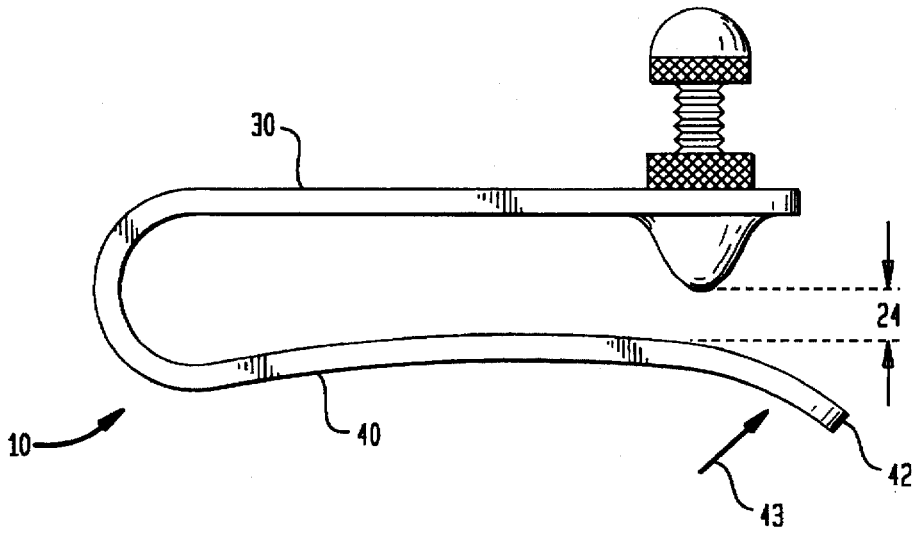
Figure 1C:
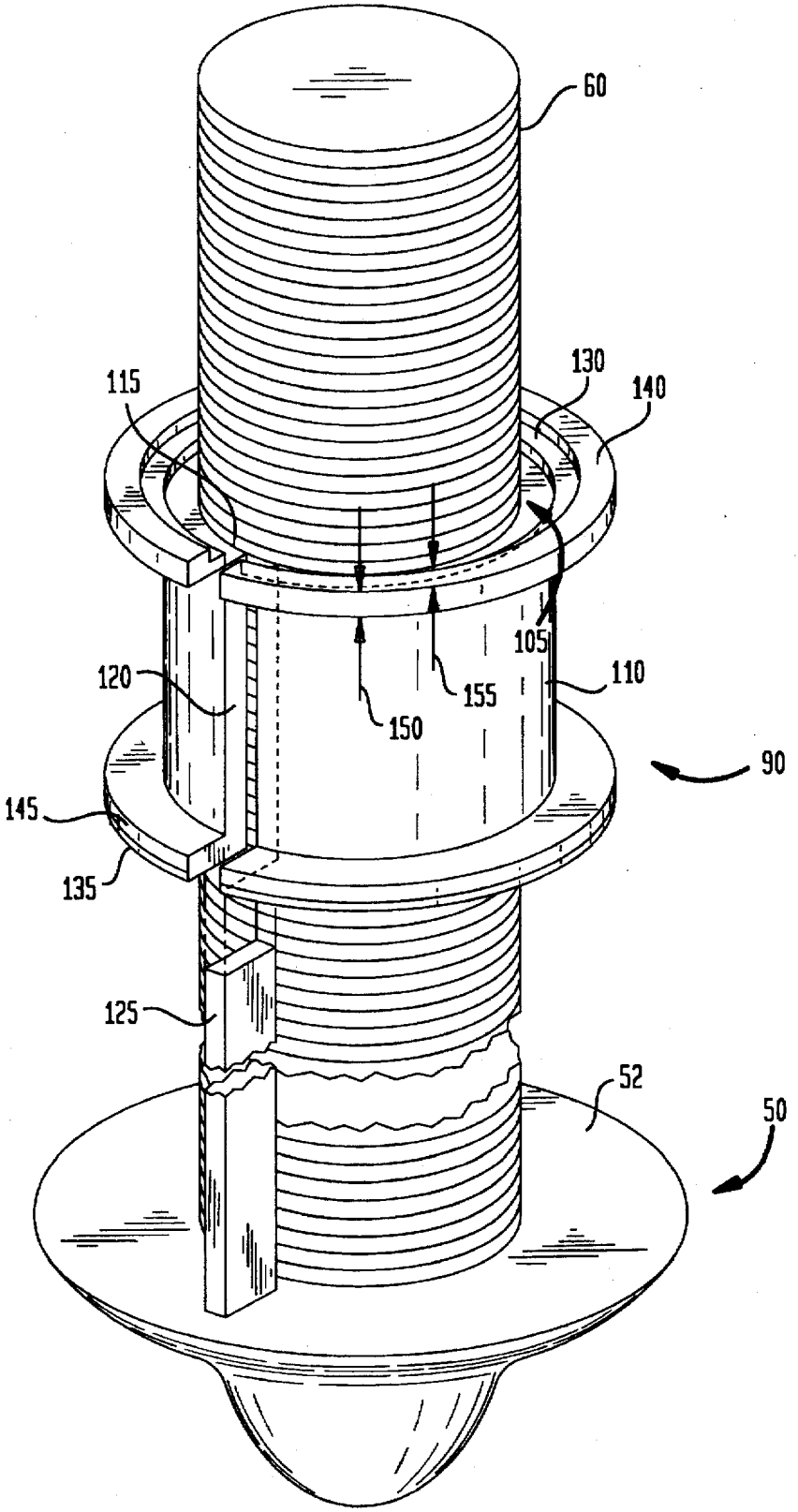

FIG. 1*c* shows the duct 90 in greater detail. The duct 90 defines a longitudinal bore 100 and has an inner surface 105 and an outer surface 110. The inner surface 105 has threads 115. The threads 115 engage the threads of the threaded post 60. The outer surface 110 is smooth and has a longitudinal notch 120 which is configured to receive a pin 125 fixedly attached to and protruding from the flat upper surface 52 of the pressure nodule 50.

Figure 1D:
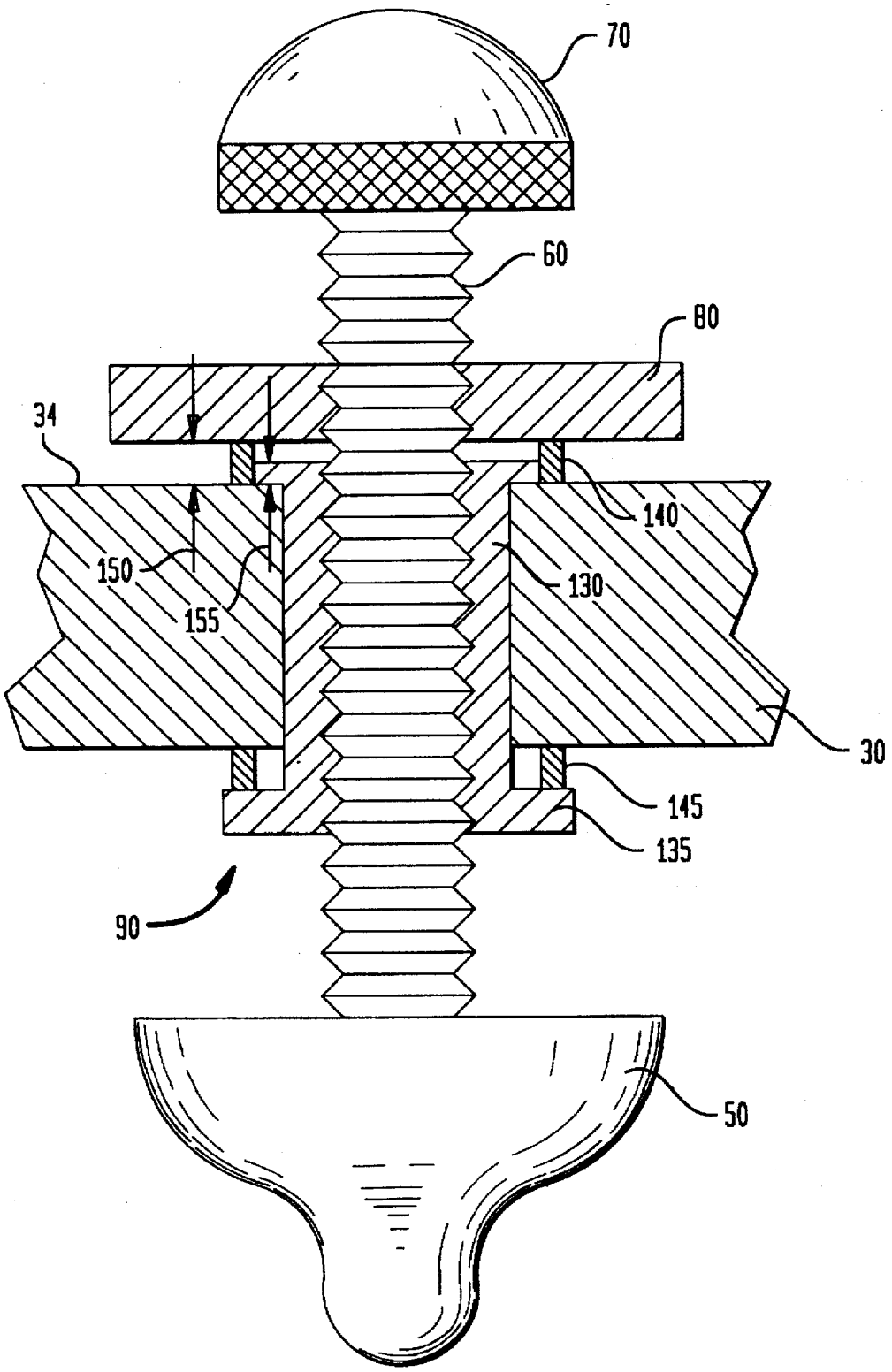

The pin 125 engages the notch 120 to prevent the swivelly attached pressure nodule 50 from turning when the threaded post 60 is turned. This prevents skin abrasion when the threaded post 60 is turned to lower the pressure nodule 50 for applying pressure on the LI-4 acupressure point. The duct 90 also has at its ends an upper lip 130 and a lower lip 135 extending outwardly from the outer surface 110. The lips 130, 135 keep the duct 90 positioned within the positioning slot 92 shown in FIG. 1*a*. An upper washer 140 (FIG. 1*d*) is positioned around the upper lip 130, while a lower washer 145 is positioned over the lower lip 135. FIG. 1*d* is a cross sectional view of the duct 90 showing the upper washer 140 located around the upper lip 130, between a knurled tightening disk 80 and the outer surface 34 of the active arm 30. The lower washer 145 is located between the lower lip 135 and the inner surface 32 of the active arm 30. The thickness 150 of the upper washer 145 is greater than the thickness of the upper lip 130. This arrangement allows fixing the position of the duct 90 within the slot 92 and the position of the threaded post 60 within the duct 90 as explained below. Furthermore, this arrangement facilitates the sliding movement of the duct 90 within the positioning slot 92. The washers 140, 145 may be rubber, plastic or other material that allows smooth sliding movement of the duct 90. Illustratively, the upper washer 140 is a rubber annulus and the lower washer 145 is a rubber O-ring.

Referring to FIGS. 1*a* and 1*d*, the knurled tightening disk 80 is threaded onto the threaded post 60 on the outer surface 34 of the active arm 30. The knurled tightening disk 80, in cooperation with the lips 130, 135 (FIG. 1*c*) of the duct 90, secures the pressure nodule 50 in a fixed position both vertically, to achieve a desired size gap 24, and horizontally along the positioning slot 92. The vertical position of the pressure nodule 50 is adjusted by turning the knurled knob 70, which in turn screws or unscrews the threaded post 60 into or out of the duct 90. The lateral position of the pressure nodule 50 is adjusted by sliding the duct 90 within the positioning slot 92 of the active arm 30. Once a desired position of the pressure nodule 50 is achieved, this desired position is fixed by rotating the tightening disk 80 so that the disk 80 presses the annulus 140 to the outer surface 34 of the active arm 30 and the O-ring 145 to the inner surface 32 of the active arm 30. Thus, tightening the disk 80 delivers a clamping force to the outer and inner surfaces 34, 32 of the active arm 30. This prevents the duct 90 from sliding within the slot 92.

The opposing arm 40 has a rounded tip 42, which is outwardly curved, for example, curved away from the pressure nodule 50. In addition, the active arm 30 also has a rounded tip 36. The tips 42 and 36 provide smooth surfaces without any sharp edges. Illustratively, the rounded tip 36 and the pressure nodule 50 are shaped to provide a continuous curved contour. The tips 42 and 36, along with the curved (e.g., bell-shaped) pressure nodule 50, make it easier to push the open end 26 of the acupressure device 10 onto a user's hand 200 shown in FIG. 2.

Figure 2:
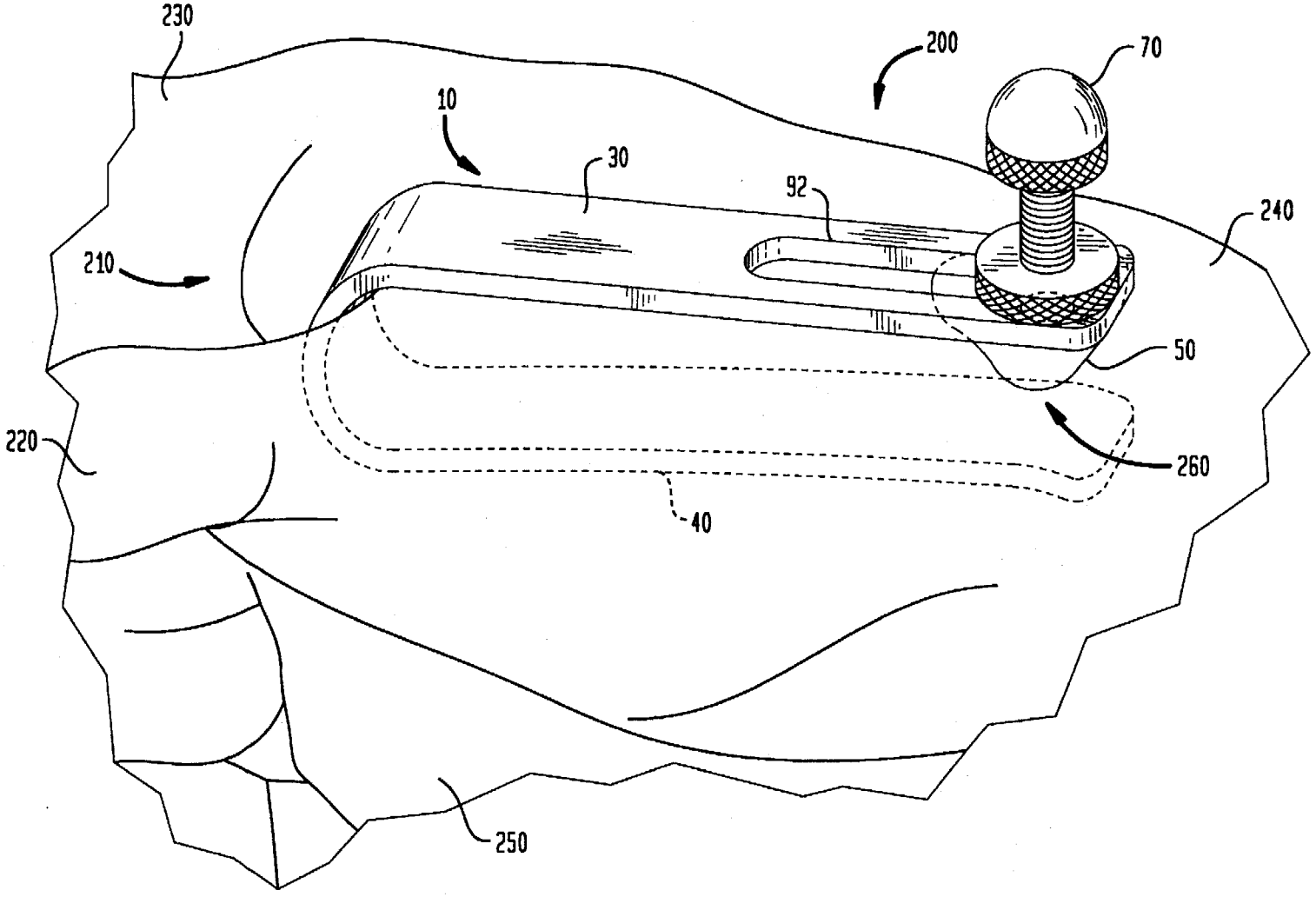
FIG. 2 shows a side view of the embodiment of an acupressure device shown in FIG. 1 as positioned on a hand.

FIG. 2 shows the acupressure device 10 placed on a right hand 200. Prior to the placement, the knurled knob 70 is turned counterclockwise, for example, to raise the pressure nodule 50, thereby widening the opening 24 (FIG. 1*b*). Thereafter, the acupressure device 10 is manipulated so that the fleshy crotch 210 between the thumb 220 and the forefinger (index finger) 230 of the right hand 200 is inserted through the opening 24 into the gap 22. The gap 22 is delineated by the inner, concave surface of the U-shaped base 20, along with the inner surfaces of the active arms 30 and the opposing arm 40 as shown in FIG. 1*a*.

The acupressure device 10 is inserted into the crotch 210 such that the pressure nodule 50 is on the backside 240 of the hand 200 and the opposing arm 40 is on the palmar surface 250 of the hand 200. The pressure nodule 50 is moved along the positioning slot 92 to position it on the LI-4 acupressure point 260. Illustratively, the acupressure device 10 may be made without the positioning slot 92. In such a case, the pressure nodule 50 is positioned over the LI-4 acupressure point 260 by moving the entire acupressure device 10.

Once the pressure nodule 50 is positioned over the LI-4 acupressure point 260, the knurled knob 70 is turned in an opposite direction, clockwise for example, to lower the pressure nodule 50, thereby exerting a desired pressure and stimulating the LI-4 acupressure point 260. Therefore, the position of the pressure nodule 50 and the pressure it exerts are easily adjustable. The tightening disk 80 is then tightened to prevent lateral movement of the duct 90 within the slot 92.

Figure 3A:
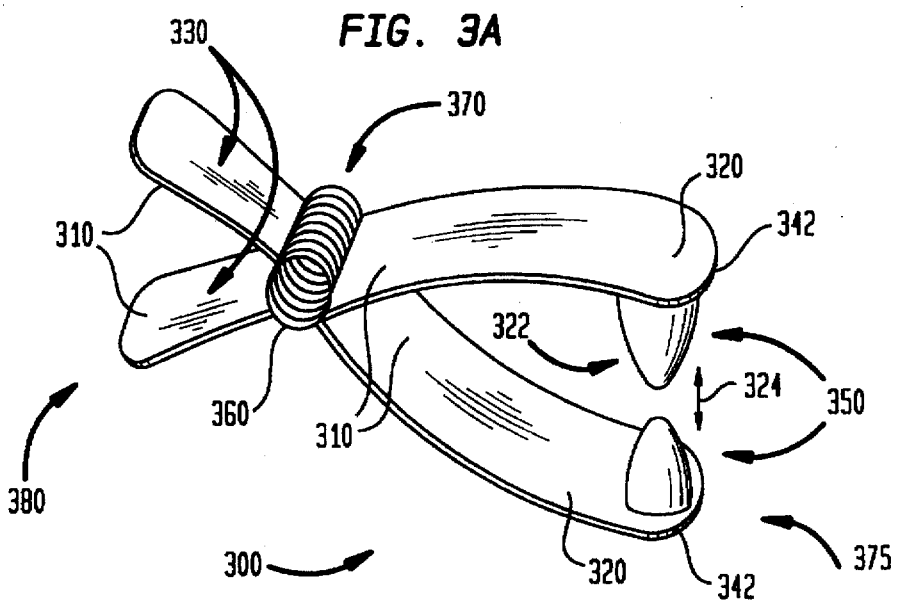
FIG. 3*a* shows a side view of another embodiment of an acupressure device according to the present invention.

FIG. 3*a* shows the acupressure device 300 having two arms 310. The two arms 310 are pivotally attached at a fulcrum 370. The fulcrum 370 is located between distal ends 375 and proximal ends 380. The distal ends 380 of the two lever arms 310 are pressure arms 320 and are separated by a gap 322 delineated by an inner surface of the pressure arms 320. The proximal ends 380 of the two arms 310 are lever arms 330.

Two opposing pressure nodules 350 are each positioned on a tip 342 of a different pressure arm 320, on the inner surface of the pressure arms 320. The two opposing pressure nodules 350 are separated by an opening 324.

A spring 360 is located at the fulcrum 370. To enlarge the opening 324 separating the two pressure nodules 350, the lever arms 330 are urged towards one another, against a compression bias of the spring 360. This causes the tips 342 of the two pressure arms 320 to displace away from one another. Since the two pressure nodules 350 are attached to the tips 342, the two pressure nodules 350 separate thereby enlarging the opening 324.

Figure 3B:
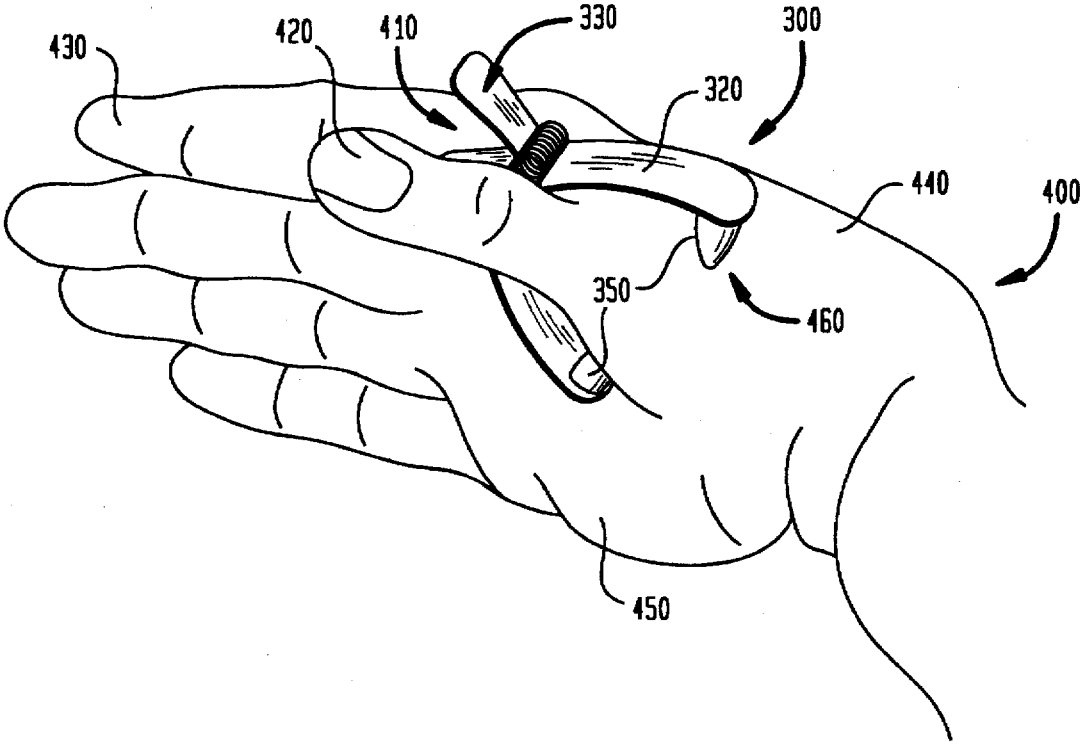
FIG. 3*b* shows a side view of the embodiment depicted in FIG. 3*a* as positioned on a hand.

While in this "open" state, the acupressure device 300 is manipulated so that the crotch 410 of a hand 400, shown in FIG. 3*b*, is inserted through the opening 324. That is, one pressure nodule 350 is positioned on the LI-4 acupressure point 460, on the backside 440 of the hand 400. The other pressure nodule 350 is positioned over the palmar surface 450 of the hand 400. The acupressure device 300 is placed on the crotch 410 between the thumb 420 and the forefinger 430 of the hand 400 in order to stimulate the LI-4 acupressure point 460.

Once properly positioned, the pressure on the lever arms 330 is released. A restoration compression force or bias of the spring 360 acts to press the two pressure arms 320 together, thereby causing the two pressure nodules 350 to clamp or pinch the crotch 410. The bias of the spring continuously transmit a comfortable level of compression force via the pressure nodule to stimulate an LI-4 acupressure point.

The pressure nodules 350 are capable of contacting an LI-4 acupressure point 460 shown in FIG. 3*b*. Because the LI-4 acupressure point 460 is on the back surface 440 of the hand 400, shown in FIG. 3*b*, only a single pressure nodule 350 need be used to apply pressure to the back surface 440 of the hand 400 so that the LI-4 acupressure point 460 is stimulated. Therefore, the acupressure device 300 can be constructed with a single pressure nodule 350, i.e., without the second pressure nodule 350 that exerts pressure on the palmar surface 450.

Illustratively, the acupressure device 10 and 300 (FIGS. 1–3) may be made in a universal size and shape, i.e., one size fits all sized hands and fits either the right or the left hand. Alternatively, they could be made in different sizes to fit various sized hands. Furthermore, they could be specially contoured and marked to fit only a left hand or only a right hand.

In normal use, the acupressure device 10 or 300, shown in FIGS. 1–3, is worn on a hand. Alternatively, two acupressure devices 10 or 300 may be worn one on each hand. Illustratively, the acupressure devices are worn until pain subsides, or professional treatment is completed.

It may be appreciated that the acupressure devices 10 and 300 (FIGS. 1–3), apply a clamping force to the crotch of a hand. Therefore, affixing the inventive device to the hand crotch, stimulates nerve endings thereat. The amount of force developed by the acupressure devices 10 and 300 (FIGS. 1–3), depends on their dimensions, the materials used in their construction and the size of the crotch of the hand to which the acupressure devices 10 and 300 are attached. It is important to design the acupressure devices 10 and 300 (FIGS. 1–3) so that they deliver the correct amount of force. If too little force is applied by the acupressure devices 10 and 300 (FIGS. 1–3), they may tend to slip off the crotch or not stimulate the LI-4 acupressure point which is deep in the crotch. On the other hand, instead of alleviating pain, too much force may readily cause headaches, oral/dental pain and sore hands.

Furthermore, different users of the acupressure devices 10 and 300 (FIGS. 1–3) can tolerate different levels of force on their LI-4 acupressure point. Some users can only tolerate small amount of force, while others can tolerate up to several pounds (lbs) of force. To accommodate different tolerances, the pressure applied by the pressure nodule 50, 350 (FIGS. 1–3), may be varied. The clamping force delivered by the acupressure devices 10 (FIG. 1) may be changed by turning the knurled knob 7, shown in FIG. 1. Similarly, for the acupressure devices 300, shown in FIG. 3*a*, the clamping force may be changed by adjusting a tension in the spring 360 via a tension adjusting screw for example (not shown). Illustratively, the spring 360 may be a coil spring or a flat spring-steel.

The acupressure devices 10 and 300 (FIGS. 1–3) are illustratively designed to deliver a different clamping force in the range of approximately one ounce to 50 lbs. Illustratively, the acupressure device 300 is designed to deliver 20 lbs of clamping force as this level of force can be tolerated by a large segment of the population. For example, the acupressure devices 10 and 300 (FIGS. 1–3) are designed to deliver the same clamping force, e.g., 5 lbs, to the hand crotch over a broad range of openings 24, 324, which are caused by different hand crotch thicknesses.

Illustratively, the openings 24 and, 324 (FIGS. 1–3) range approximately from 0.1" to 0.5" in a state of rest. Furthermore, the tips 342 of the pressure arms 320 (FIG. 3*a*) are capable of experiencing a separation of up to approximately 2" without permanently deforming the spring 360. Similarly, the tips 36 and 42 (FIG. 1*a*) are capable of experiencing a separation of up to approximately 4" without permanently deforming the U-shaped base 20. Illustratively, the openings 24 and 324 (FIGS. 1–3) are separated up to approximately 1" wide during use.

The spring base 20, shown in FIG. 1*a*, is made out of springy plastic or metal such as stainless steel for example. However, any elastic material can be used which generates the requisite force over the range of deflections produced by the expected range of hand crotch thicknesses. Stainless steel also offers an advantage in that it is easy to form.

As depicted in FIG. 1*a*, the U-shaped spring base 20 illustratively has an approximately semi-circular portion 21, with a radius of curvature 23 in the range of approximately 0.25" to 1", e.g., the radius of curvature may be 0.5".

The U-shaped spring base 20 (FIG. 1*a*) extends to form the active arm 30 and the opposing arm 40, shown in FIG. 1*a*. The active arm 30 and the opposing arm 40 shown in FIG. 1*a*, and the pressure arms 320, shown in FIG. 3*a*, have a length between approximately 1" and 2", and a width between approximately 0.25" and 1". For hygienic purposes, disposable sleeves (not shown) that fit on the active arm 30, the opposing arm 40 (FIG. 1*a*), and the pressure arms 320 (FIG. 3*a*) may be used. The disposable sleeves may be changed each time a different user uses the acupressure device of the present invention and the materials may be sterilized.

Similarly, the dimensions of the lever arms 330, shown in FIG. 3*a*, can vary greatly. Larger lever arms 330 provide greater control while a smaller lever arms 330 are less obstructive. Illustratively the lever arms 330 are a flat rectangular plate with rounded tips 480 (FIG. 4). For example, the lever arms 330 may be 0.5" long, 0.5" wide, 0.15" thick.

Figure 4A:
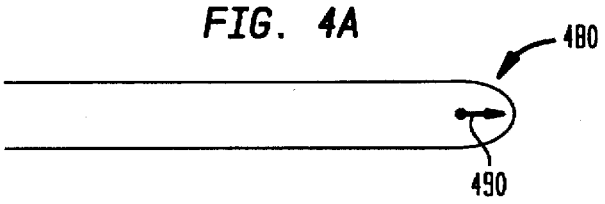
FIG. 4*a* shows a side view of a representative tip of the acupressure device in greater detail.
Figure 4B:
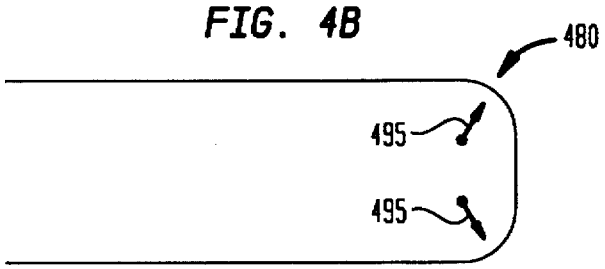
FIG. 4*b* shows a top view of a representative tip of the acupressure device in greater detail.

FIG. 4 shows a side and top view of a tip 480 representative of any one of the tips 36, 42 (FIG. 1). Illustratively, the tip 480 has a semicircular rounded contour without any sharp edges. The radius of curvature 490 of a side view of the tip 480, shown in FIG. 4*a*, is approximately 0.075". Similarly, the radius of curvature 495 of a top view of the tip 480, shown in FIG. 4*a*, is approximately 0.25".

FIG. 1*b* shows the outwardly curved tip 42 of the opposing arm 40. Illustratively, the radius of curvature 43 is 0.2".

Turning now to FIG. 5, the pressure nodule 50 is shown in greater detail. The diameter, profile and softness of the pressure nodule 50 all interplay to render a comfortable interface to the LI-4 acupressure point.

Figure 5A:
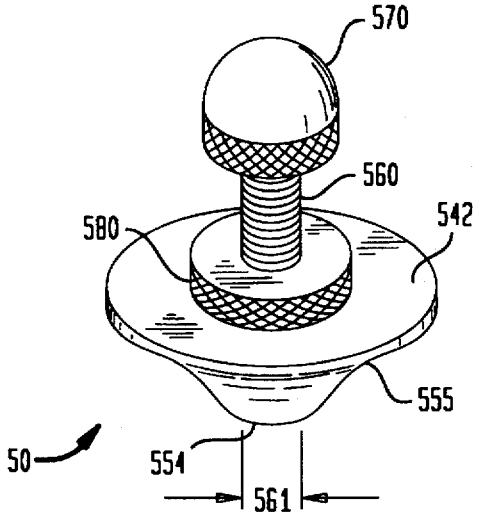
FIG. 5*a* shows a side view of an adjustable pressure nodule of the embodiment depicted in FIG. 1 in greater detail.
Figure 5B:
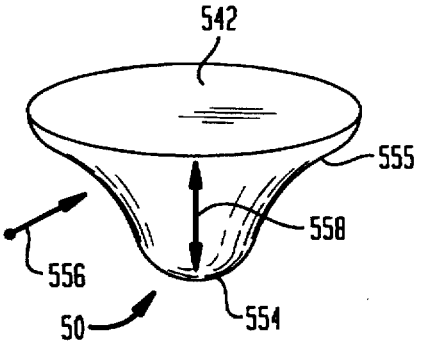
FIGS. 5*b* and 5*c* show a side view of a pressure nodule in greater detail.
Figure 5C:
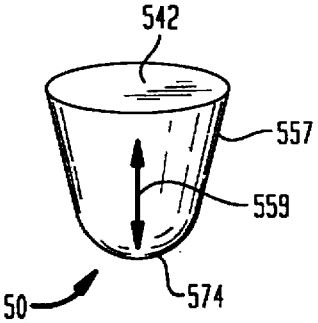

Illustratively, the pressure nodule 50 has flat surface 542, a blunt-nosed projection 554 and an inverted bell-shape 555 as shown in FIGS. 5*a* and 5*b*. Alternatively, the pressure nodule 50 has a parabolic shape 557 with a rounded projection 574 as shown in FIG. 5*c*.

FIG. 5*a* also shows the attachment to the flat surface 542 as described earlier in connection with the acupressure device 10, shown in FIG. 1. In particular, the flat surface 542 is attached to the threaded post 560, which is terminated by the knurled knob 570. The threaded post 560 also goes through the knurled tightening disk 580. Illustratively, the knurled knob 570 is secured to the threaded post 560 using a bonding agent such as solder, epoxy, acrylic cement, etc.

Illustratively, the arc radius 556 of the bell-shaped profile is approximately 0.5". The distance 558 from the flat surface 542 to the blunt nose 554 is 0.4" for example. Similarly, the parabolic profile 557 extends a distance 559 of approximately 0.5" from the flat surface 542 to the rounded projection 574. The diameter 561 of blunt-nose 554 is chosen to be in the range of approximately 0.15" to 0.3".

Figure 6A:
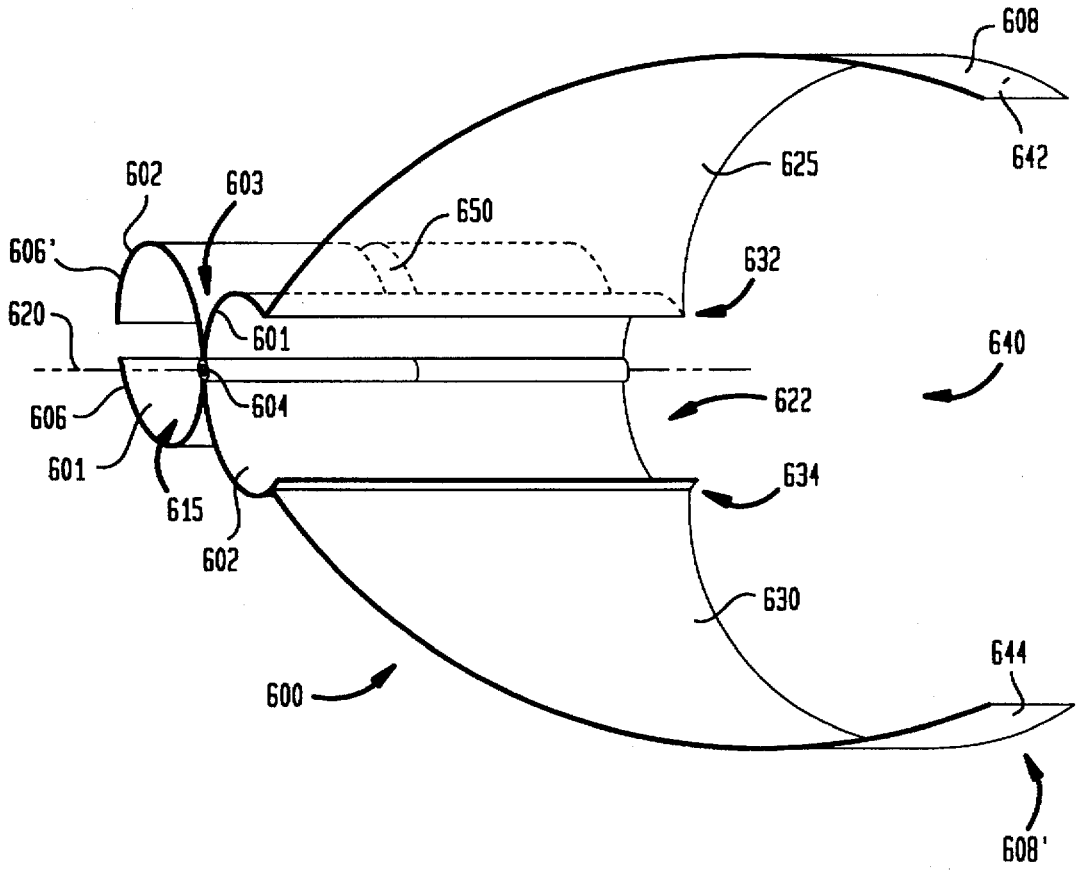
FIGS. 6*a* and 6*b* show another embodiment of the present invention having two tubular springs.
Figure 6B:
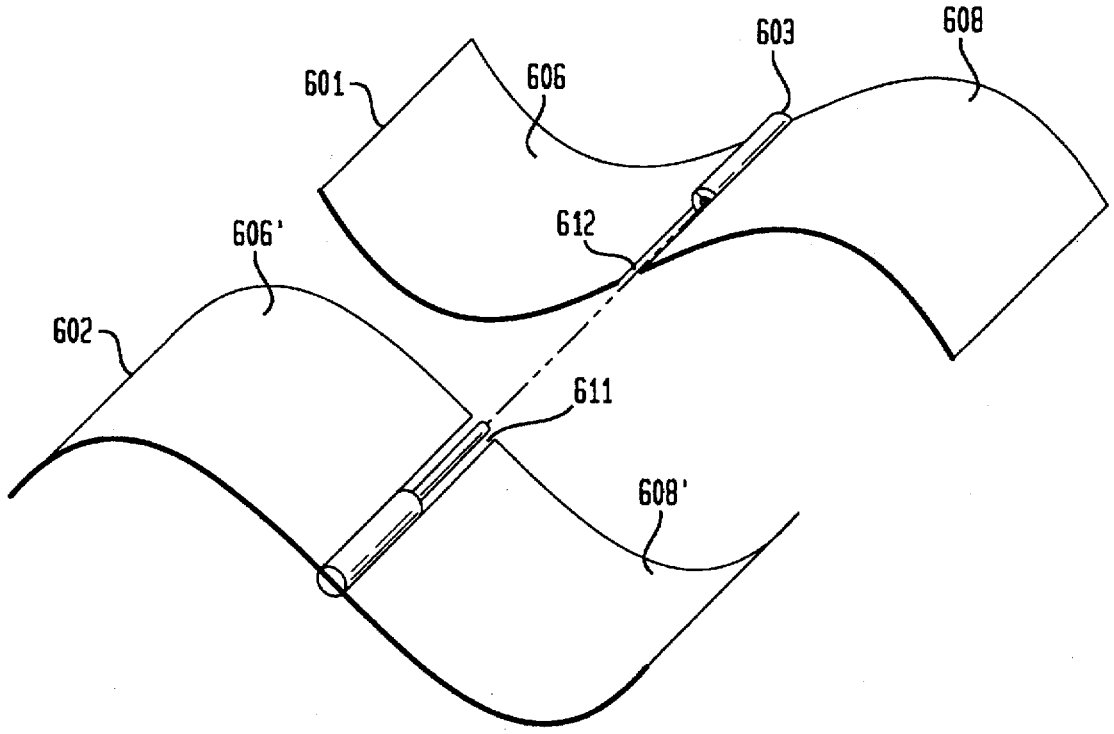

FIGS. 6*a* and 6*b* shows another embodiment of the present invention. The acupressure device 600 shown in FIG. 6 has two arms 601 and 602 that are connected at a fulcrum 603 in a scissoring configuration. Each of the arms is a curved sheet with an S-shaped cross-section. As shown, each arm 601 and 602 has a slot 611 or 612 which extends approximately half way across the sheet perpendicularly to the cross-section. The arms 601, 602 are assembled by inserting the slot 611 portion of the arm 601 into the slot 612 of the arm 602. Note that the slots 611, 612 and the fulcrum 603 are parallel and may also be collinear. A center spring 604, such a coil spring may be provided at the center of the fulcrum for biasing the arms 601 and 602 in a closed position.

The arm 601 has a proximal end 608 on one side of the fulcrum 603 and a distal end 606 on the other side of the fulcrum 603. Likewise, the arm 602 has a proximal end 608' on the same side of the fulcrum 603 as the proximal end 608 of the arm 601 and a distal end 606' on the same side of the fulcrum 603 as the distal end 606 of the arm 602. Opposing clamping arms 625, 630 extend from opposite longitudinal edges 632, 634 of the proximal ends 608, 608' away from the fulcrum 603. The clamping arms 625, 630 define an opening 640 into which the crotch of a hand may be inserted. Opposing clamping ends 642, 644 of the clamping arms 625, 630, respectively, exert pressure on the back and palmar sides of the hand, Alternatively, a pressure nodule, similar to the pressure nodules 50 of FIGS. 5*b* and 5*c* may be attached to one or both ends 642, 644.

Figure 7:
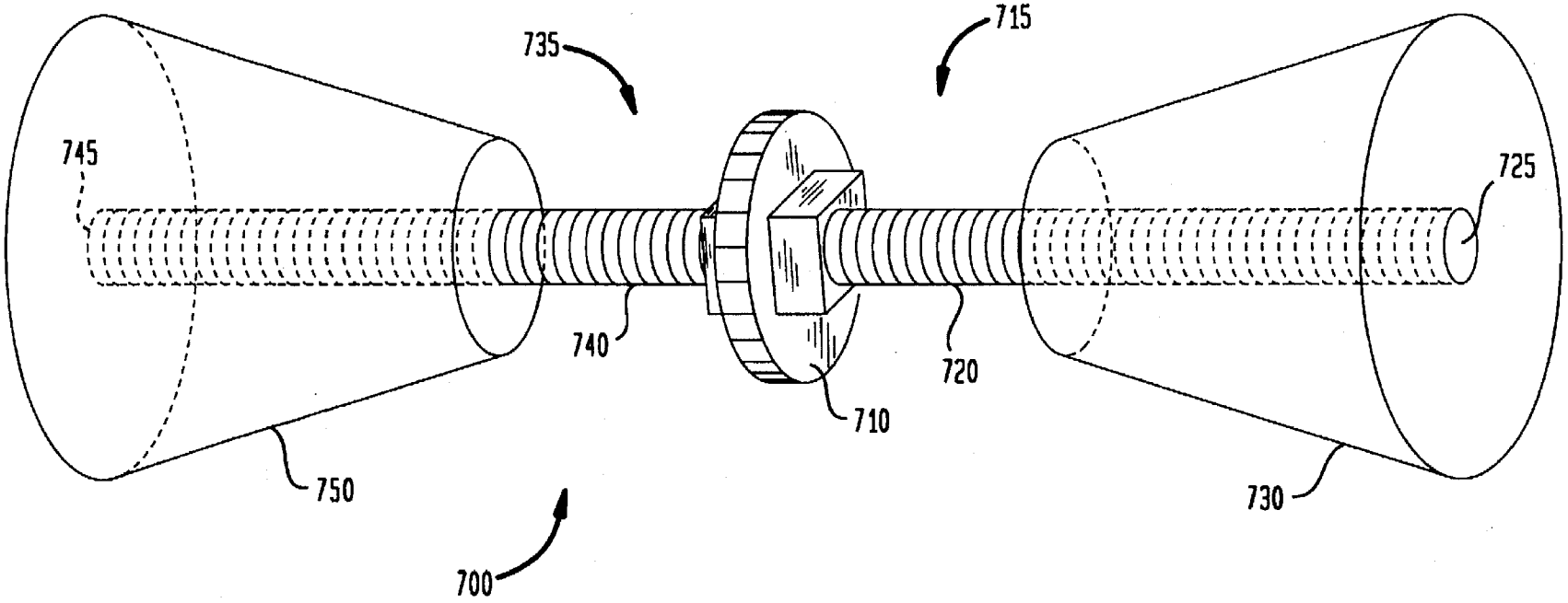
FIG. 7 shows a tension adjusting device used in conjunction with the embodiment shown in FIGS. 6 and 8*a–b;*

Normally, the ends 642, 644 are in an closed position (at a minimal separation). A tension adjusting device 700, to be described later in connection with FIG. 7, is provided to increase the separation between the ends 642, 644. The tension adjusting device 700 is located within the cylindrical space 615 delineated by the distal ends 606, 606' of the arms 601, 602. The distal end 606 of the arm 601 has a slot 650 which is perpendicular to the longitudinal axis 620. A wheel 710, such as a thumbwheel, of the tension adjusting device 700 shown in FIG. 7 protrudes from the slot 650.

FIG. 7 shows the tension adjusting device 700. Both sides of the wheel 710 are fixedly attached to screws or threaded posts. The wheel 710 may be a knurled wheel to facilitate turning. The wheel 710 is attached, on one side 715, to a threaded post or shaft 720. The threaded post 720 engages a threaded hole 725 that traverses a wedge 730. The wheel 710 is attached, on the other side 735, to a threaded post having reversed threads, or a reverse threaded post 740. The other end of the reverse threaded post 740 engages a threaded hole 745 of a second wedge 750.

The wedges 730, 750 are tapered having a larger diameter at the side farthest from the wheel 710 and a smaller diameter at the side nearest to the wheel 710. The smaller diameter of the wedges 730, 750 is slightly smaller than the diameter of the inner cylindrical space 615 separating the distal ends 606, 606' of the arms 601, 602 FIG. 6 in the normal stress-free condition so that they fit therein. The wheel 710 protrudes from the slot 650 of the spring 615.

In the normal stress-free condition, the small diameter end of the wedges 730, 750 are slightly inserted into the cylindrical space 615 until the diameter of the wedges 730, 750 equals the diameter of the cylindrical space 615.

To vary the size of the opening 640 or the separation between the two concave arms 625, 630, the wheel 710 is turned. Turning the wheel 710 also turns the threaded posts 720, 740 since they are fixedly attached to the wheel 710. The rotation of the threaded posts 720, 740, in cooperation with the threaded holes 725, 745, draws the wedges 730, 750 toward the wheel 710. Thus, the wedges 730, 750 penetrate deeper into the cylindrical space 615. Since the wedges 730, 750 are tapered, the wedges 730, 750 enlarge the separation of the distal ends 606, 606' of the arms 601, 602 as they are drawn into the cylindrical space 615. This in turn opens the proximal ends 608, 608' by a scissoring action of the arms 601, 602. This separates the two concave arms 625, 630 against a restoration bias of the center spring 604. Thus, the opening 640 between the ends 642, 644 of the two concave arms 625, 630 increases.

To narrow the separation between the two concave arms 625, 630, the wheel 710 is turned in the other direction. Turning the wheel 710 in the other direction, moves the wedges 730, 750 away from the wheel 710. This causes the wedges 730, 750 to recede from inside the cylindrical space 615. The restoration bias of the center spring 604 reduces the separation of the distal ends 606, 606' of the arms 601, 602. Thus, the two clamping arms 625, 630 move closer together. This reduces the size of the opening 640.

The acupressure device 600 is used as follows. The wheel 710 is turned to separate the clamping arms 625, 630. This increases the opening 640 until it is sufficiently large enough to insert the crotch of the hand therein. The thumb wheel 710 is rotated in the opposite direction to close the clamping arms 625, 630. The clamping arms 625, 630 are closed sufficiently to deliver the appropriate amount of stimulating pressure to the LI-4 nerve endings. To release, the thumb wheel 710 may be rotated to enlarge the separation of the clamping arms 625, 630.

Figure 8A:
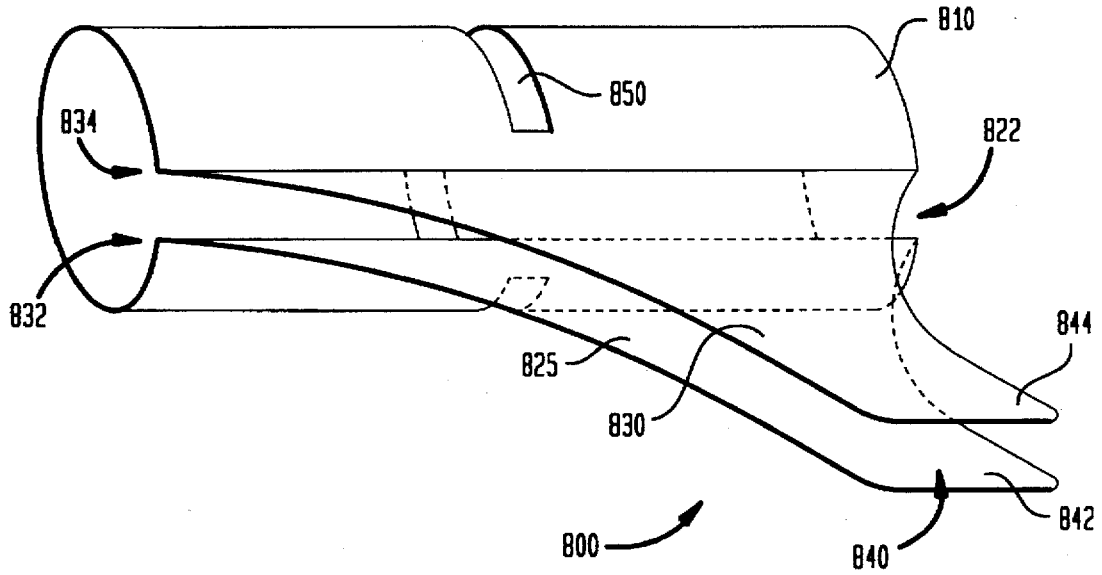
FIG. 8*a* shows another embodiment of the present invention having a tubular spring.
Figure 8B:
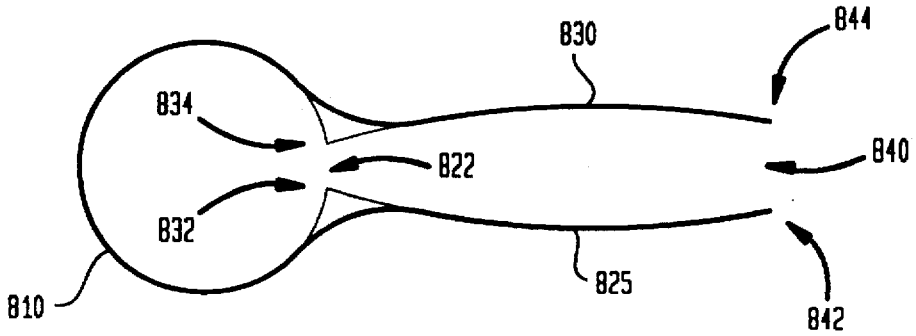
FIG. 8*b* shows a cross section of the acupressure device shown in FIG. 8*a;*

FIGS. 8*a*, 8*b* show another embodiment of the present invention. The acupressure device 800 has a single, nearly cylindrical, tubular spring 810. Illustratively, the tubular spring 810 has an end-to-end gap 822 longitudinally formed in one side. Thus, the tubular spring 810 has a C-shaped cross-section. Two concave arms 825, 830 are attached to the tubular spring 810. One gap edge 832 of the tubular spring 810 is attached to a first concave arm 825, while the other gap edge 834 of the tubular spring 810 is attached to a second concave arm 830.

The two concave arms 825, 830 define a small opening 840 having a size similar to the separation between the ends 832, 834 of the tubular spring 810. Thus, in the normal stress-free position, the acupressure device 800 is in a closed position. The ends 842, 844 of the two concave arms 825, 830 are opposite each other and in a closed position, exert pressure on the back side and palmar side of a hand, thus stimulating the LI-4 acupressure point. Alternatively, a pressure nodule, similar to the pressure nodules 50 of FIGS. 5*b* and 5*c*, may be attached to one or both ends 842, 844.

Normally, when the spring 810 is in a state of rest, the ends 842, 844 are in a closed position with only a small separation between them. A tension adjusting device, such as the tension adjusting device 700 of FIG. 7, is provided for enlarging the separation between the ends 842, 844. The tension adjusting device 700 is located within the tubular spring 810. The tubular spring 810 has a slot 850 which is perpendicular to the longitudinal axis of the cylindrical spring 810. The wheel 710 of the tension adjusting device 700 of FIG. 7 protrudes from the slot 850. The wedges 730, 750 fit into a respective end of the spring 810. In the normal stress-free condition, the small diameter end of the wedges 730, 750 are slightly inserted into the spring 810 until the diameter of the wedges 730, 750 equals the diameter of the spring 810.

To vary the size of the opening 640 or the separation between the two concave arms 825, 830, the wheel 710 is turned. When the wheel 710 (and the threaded posts 720, 740) is turned in one direction, the wedges 730, 750 are drawn toward the wheel 710. Thus, the wedges 730, 750 penetrate deeper into the tubular spring 810. Since the wedges 730, 750 are tapered, the wedges 730, 750 enlarge the diameter of the spring 810 as they are drawn into the spring 810.

By increasing the diameter of the tubular spring 810, the gap 822 is widened against a restoration bias of the spring 810. This, in turn, separates the two concave arms 825, 830 and enlarges the opening 840 between the arm ends 842, 844. The opening 840 is enlarged sufficiently to permit insertion of a crotch of a hand through the enlarged opening 840.

To produce stimulating clamping pressure, the wheel 710 is turned in the other direction. Turning the wheel 710 in the other direction, moves the wedges 730, 750 away from the wheel 710. This forces the wedges 730, 750 to recede from inside the tubular spring 810. The restoration bias of the spring 810 reduces the diameter of the spring 810.

The reduced tension on the spring 810, which reduces the diameter of the spring 810, causes the two concave arms 825, 830 to move toward each other. This reduces the size of the opening 840 back towards its small original size. As a result, the arm ends 842 and 844 deliver a clamping force to the LI-4 pressure point. In use, the wheel 710 may be further turned to adjust the pressure on the contact points of the hand until a desired clamping force is generated. To release the clamping force on the LI-4 acupressure point, the opening 840 is enlarged by turning the wheel 710 to pull the wedges 730, 750 toward the wheel 710 into the tubular spring 810.

The length of the tubular springs 610, 615, 810 of FIGS. 6, 8 is approximately between 0.5" and 1.0". Therefore, the springs 610, 615, 810 fit between the thumb and forefinger of a hand. The tubular springs 610, 615, 810 may be made of metal, such as steel, plastic, metal covered with plastic or any other suitable resilient material. The concave arms 625, 630, 825, 830 are made from a stiff material, such as stiff metal, plastic or metal imbedded in plastic.

Figure 9:
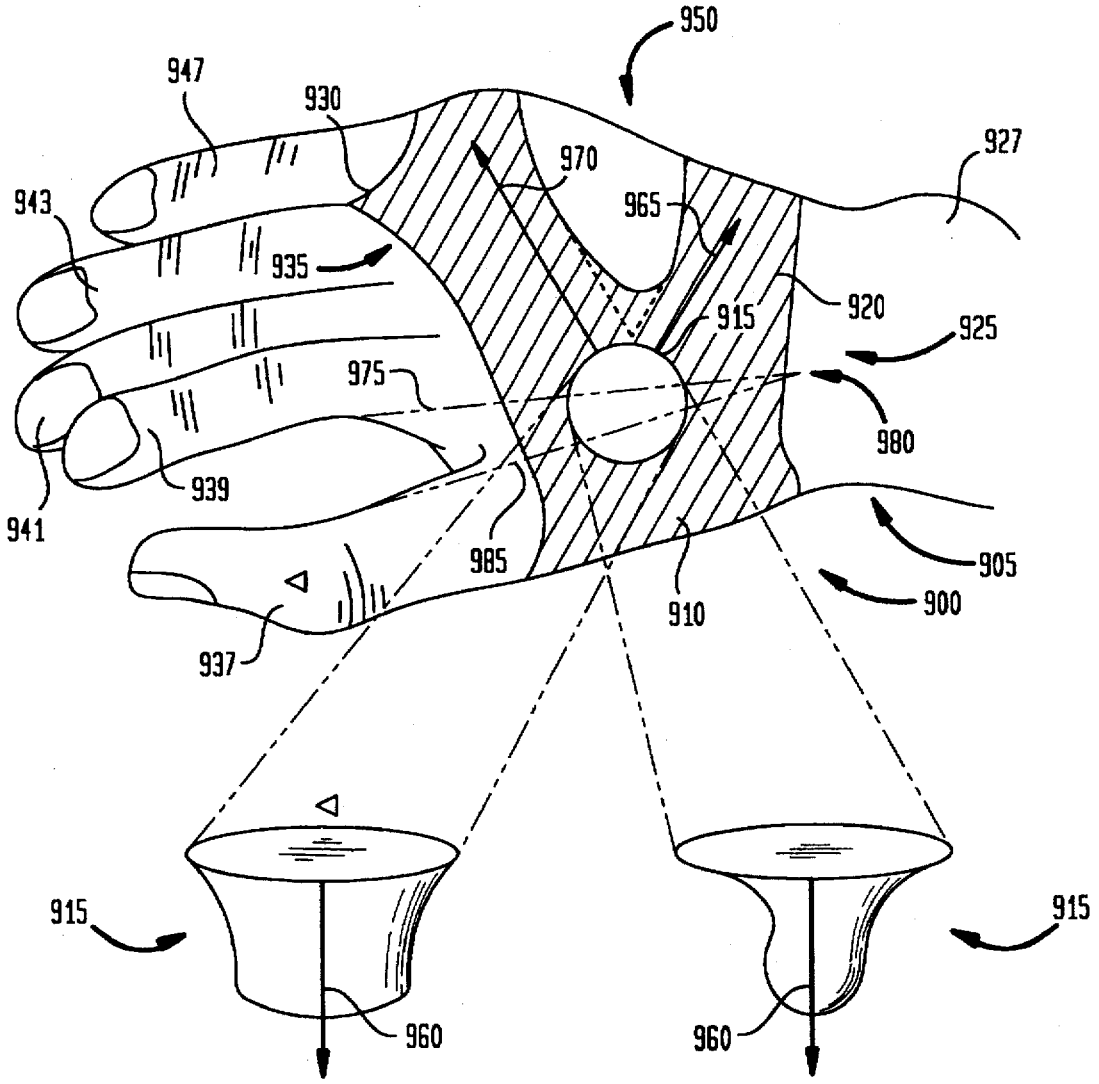
FIG. 9 shows another embodiment of the present invention having an elastic band as inserted onto a hand.
Figure 10:
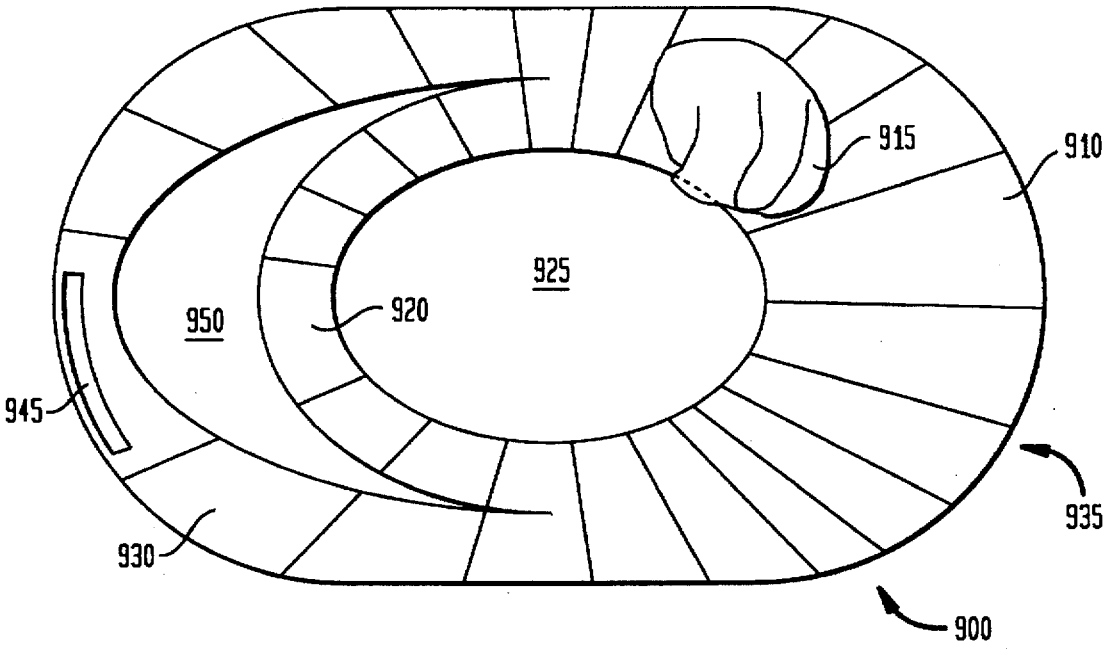
FIG. 10 shows a frontal view of the embodiment shown in FIG. 9.
Figure 11:
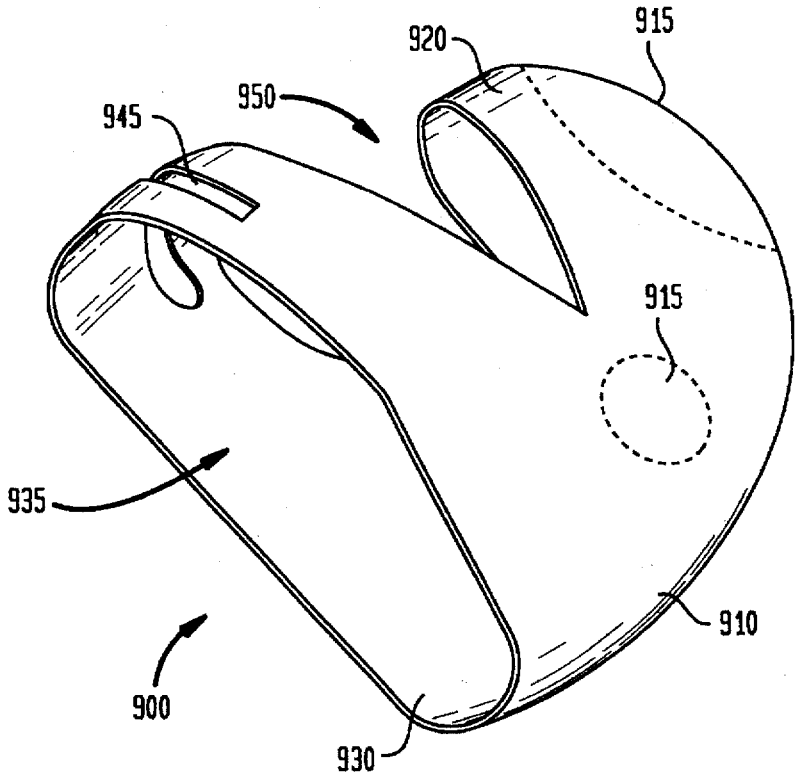
FIG. 11 shows the embodiment shown in FIG. 9 without the hand.

FIG. 9 shows another embodiment of the present invention. FIG. 9 shows an acupressure device 900 inserted into a hand 905. FIG. 10 shows a frontal view of the acupressure device 900 while FIG. 11 shows the acupressure device 900 without the hand 905 of FIG. 9. The acupressure device 900 has an elastic band 910 and a pressure nodule 915 which exerts pressure on the LI-4 acupressure point of a hand 905. The elastic band 910 may be made of any elastic material capable of applying sufficient pressure when stretched over the hand 905 in a manner described below.

Referring to FIGS. 9–11, the elastic band 910 may be formed by two band portions; a first band portion 920 and a second band portion 930. The first and second band portions 920, 930 meet and are integral at a portion of the palm extending from the base of the thumb 937 to the heel of the palm. The first band portion 920 wraps around the heel of the palm and the lower portion of the backhand near the wrist 927. The first band portion 920 defines a first opening 925. The second band portion 930 wraps around the palm and backhand from the base of the thumb 937 to the pinkie 947. The second band portion 930 defines a second opening 935. The second opening 935 surrounds the base of the thumb 937, forefinger 939, middle finger 941 and ring finger 943 of the hand 905. Illustratively, the second portion 930 has a pinkie hole 945 into which the pinkie 947 is inserted. A third opening 950 separates the first and second band portions 920, 930. The elastic band 910 is not cumbersome and provides for simple positioning of the pressure nodule 915 on the LI-4 acupressure point.

Figure 12:
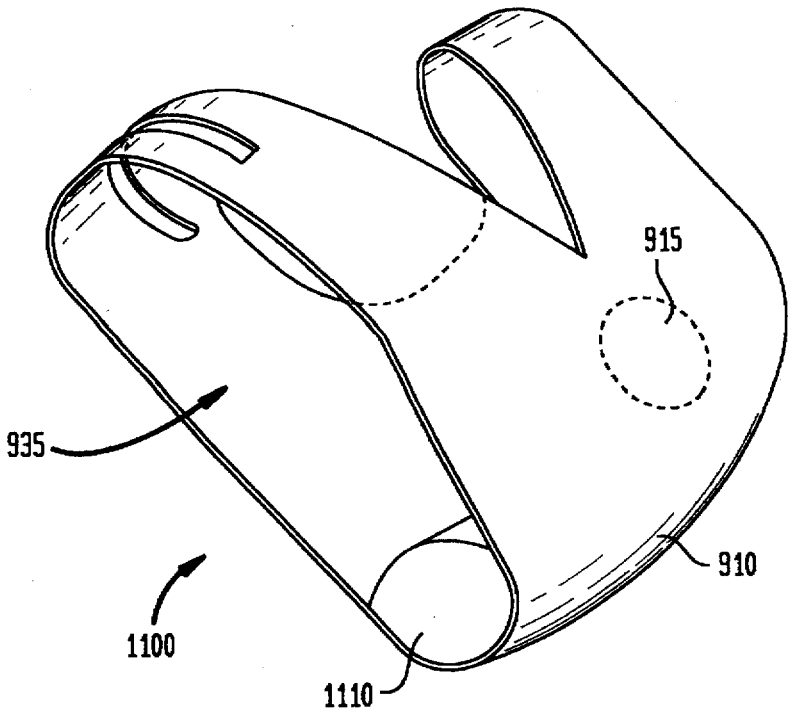
FIG. 12 shows another embodiment of the present invention having a thumb opening in an elastic band similar to that shown in FIG. 9.

FIG. 12 shows an acupressure device 1100 which is another embodiment of the present invention similar to the acupressure device 900 of FIG. 9 except for an additional thumb opening 1110. The thumb opening 1110 extends over the lower portion of the thumb 937 to surround the thumb 937 (FIG. 9). In the acupressure device 1100, the thumb is inserted into the thumb opening 1110. The second opening 935 of the elastic band 910 only surrounds the base of the forefinger 939, middle finger 941 and ring finger 943 of the hand 905 (FIG. 9).

In yet another embodiment, the second opening 935 of the elastic band 910 may extend over the four fingers of the hand 905 excluding the pinkie 947. The extended second opening 935 may be divided into four individual openings, one for each of the four fingers. In this embodiment, the acupressure device resembles a glove with short cut-off fingers, such as a weight-lifter's or automobile driver's glove. Alternatively, the bands may be incorporated into a full glove, such as a golfing or a batting glove.

The previous embodiments of the present invention are pincer type devices with arms, wherein at least one arm has a half-rounded or half-egg-shaped pressure nodule, which may be plastic. The previous embodiments apply pressure in one (down) or two (up and down) directions. The elastic band 910 is stretchable over the hand 905 and exerts three separate forces which pull/push the pressure nodule 915 in three different directions. This provides optimal stimulation of the LI-4 acupressure point.

The three forces shown in FIG. 9 are:

(1) A downward force 960 acting on the pressure nodule 915 from the top or back of the hand 905 toward the LI-4 acupressure point;

(2) A first lateral force 965 which pulls the pressure nodule 915 toward a point on the backhand opposite the thumb 937 between the base of the pinkie 947 and the wrist 927; and (3) A second lateral force 970 which pulls the pressure nodule 915 toward the base of the pinkie 947.

These three forces combine to push the pressure nodule 915 down into the fleshy portion of the back of the hand 905, between the thumb 937 and the forefinger 939, i.e., the LI-4 acupressure point. At the same time, the three forces pull the pressure nodule 915 sideways against the bone 975 of the forefinger 939. The forefinger bone 975 makes a "V" 980 with the thumb bone 985. The interaction of the three forces assure adequate, maintainable, reproducible, and beneficial stimulation of the LI-4 acupressure point by the pressure nodule 915.

Figure 13:
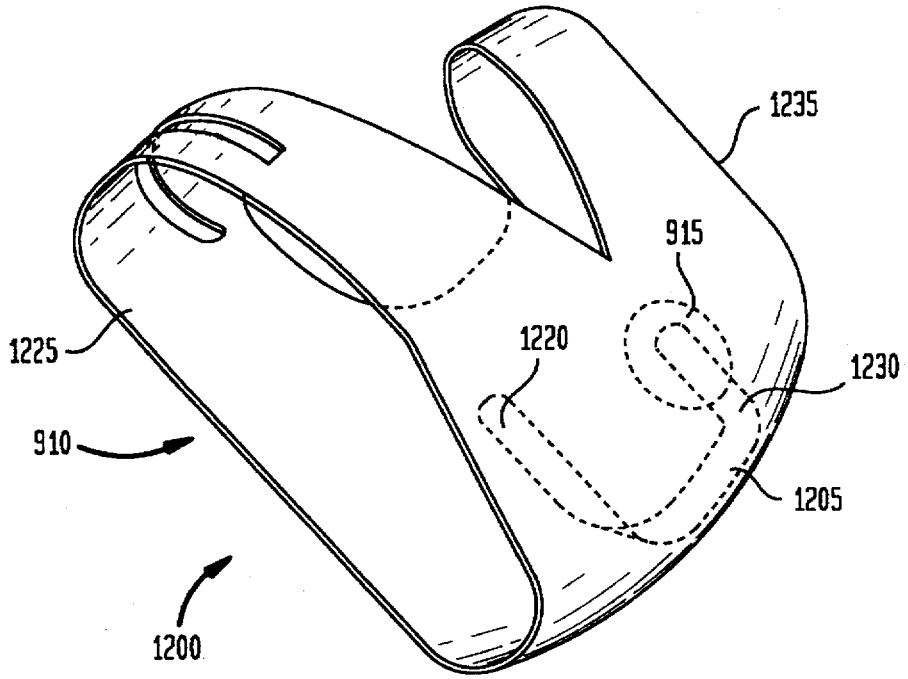
FIG. 13 shows another embodiment of the present invention with a U-shaped spring.

FIG. 13 shows an acupressure device 1200 which is another embodiment of the present invention similar to the acupressure device 900 of FIG. 9 except for an additional built-in spring 1205. The spring 1205 is U-shaped and is attached to the outer or inner surface of the band 910 or imbedded therein.

The U-shaped spring 1205 may have one side of the U longer than the other side. For example, the side 1220 located at the palmar or lower side 1225 of the band 910 is longer than the side 1230 located at the back or upper side 1235 of the band 910. The tip of the side 1230 of the spring 1205 is located above the flat surface of the pressure nodule 915.

The tension of the U-shaped spring 1205 is easily adjustable, for example, by bending the sides 1220, 1230 toward each other or away from each other prior to inserting the hand into the band 910. The U-shaped spring 1205 may be metal, plastic, a combination of metal and plastic or any other resilient material.

The band 910 may produce the same tension as the elastic band 910 and exerts the same three forces exerted by the elastic band 910. Alternatively, the band 910 may produce less tension than the elastic band 910. In the case where the band 910 produces less tension than the elastic band 910, the tension of spring 1205 provides the downward force on the pressure nodule 915 necessary for stimulating the LI-4 acupressure point. In the case where the band 910 produces similar tension as the elastic band 910 of FIG. 9, which exerts the three forces on the pressure nodule 915 discussed in connection with the elastic band 910, the spring 1205 provides a further downward force on the pressure nodule 915.

Figure 14:
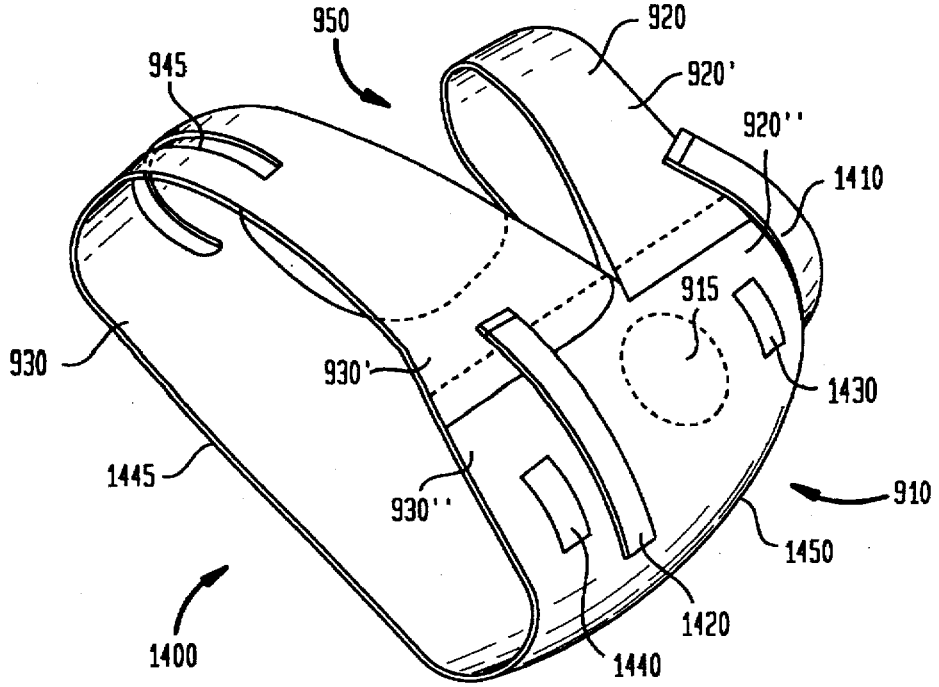
FIG. 14 shows another embodiment of the present invention with adjustment straps.

FIG. 14 shows an acupressure device 1400 which is another embodiment of the present invention similar to the acupressure device 900 of FIG. 9. The acupressure device 1400 has first and second adjustment straps 1410, 1420.

Illustratively, the adjustment straps 1410, 1420 are velcro straps each having corresponding first and second stick-on patches 1430, 1440. The velcro straps 1410, 1420 and the first and second stick-on patches 1430, 1440 are attached to the outer surface of the elastic band 910. The straps 1410, 1420 and patches 1430, 1440 may be located on the lower palmar side 1445 or the upper side 1450 of the elastic band 910. The straps 1410, 1420 may be attached to the side of elastic band 910 near the pinkie hole 945 and third opening 950, while the patches 1430, 1440 may attached to the side of elastic band 910 away from the pinkie hole 945 and third opening 950, or vice versa.

Illustratively, as shown in FIG. 14, the straps 1410, 1420 and patches 1430, 1440 are attached to the upper side 1450 of the elastic band 910. The first strap 1410 is attached to the first band portion 920 near the third opening 950, while the first patch 1430 is attached to the first band portion 920 away from the third opening 950. The second strap 1420 is attached to the second band portion 930 near the pinkie hole 945, while the second patch 1440 is attached to the second band portion 930 away from the pinkie hole 945.

In an alternative embodiment, band portions 920, 930 need not be continuous ring-like bands. Rather, they can be discontinuous band straps with ends 920', 920" and 930', 930". By attaching the straps 1410 and 1420 to patches 1430 and 1440, respectively, the end 920' is joined to the end 920" and the end 930' is joined to the end 930" to form ring-shaped band portions 920, 930.

After inserting the elastic band 910 over a hand, the tension on the first and second band portions 920, 930 may be increased using the velcro straps 1410, 1420. The velcro straps 1410, 1420 are pulled toward the patches 1430, 1440 and attached thereon when a desired tension is achieved. This adjusts the forces that act on the pressure nodule 915 to stimulate the LI-4 acupressure point. The first strap 1410 directly adjusts the first lateral force 965 (FIG. 9), while the second strap 1420 directly adjusts the second lateral force 970 (FIG. 9). In addition, adjusting the first and second straps 1410, 1420 indirectly varies the downward force 960 (FIG. 9).

In this embodiment, the pinkie hole 945 of the acupressure device 1400 is larger than a corresponding hole in an embodiment without adjustment straps, such as the acupressure device 900 shown in FIG. 9. The larger pinkie hole 945 of the acupressure device 1400 prevents pulling the pinkie when the second straps 1420 is adjusted to tighten the second band portion 930.

The pressure nodule 915 may be a half-rounded or half-egg-shaped pressure nodule similar to the pressure nodules 50 of FIGS. 5*b* and 5*c*. A flat surface of the pressure nodule 915 is attached, e.g., glued, to the elastic band 910 below the third opening 950. A blunt-nosed projection, located opposite the flat side of the pressure nodule contacts the LI-4 acupressure point.

Figure 15A:
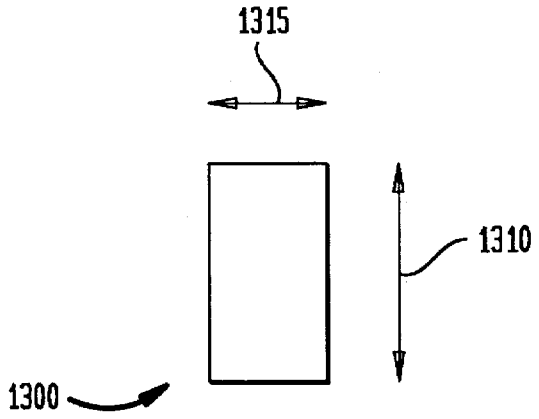
FIG. 15*a* shows a horizontal cross section of a pressure nodule according to the present invention.
Figure 15B:
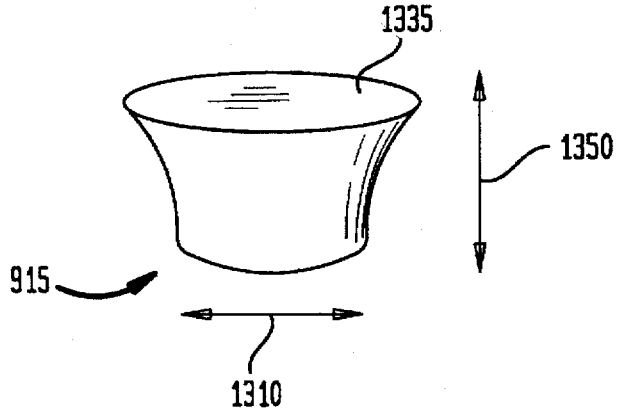
FIG. 15*b* shows a broad view of the pressure nodule of FIG. 15*a;*
Figure 15C:
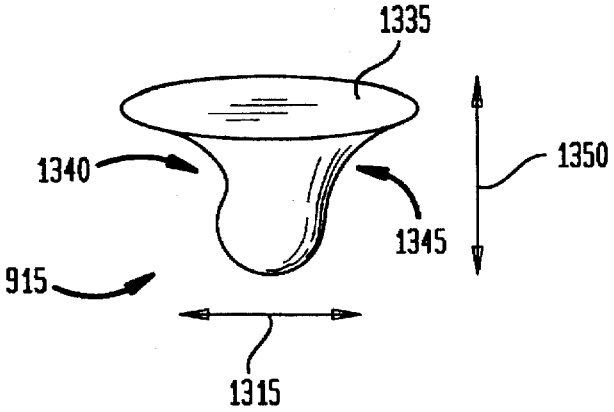
FIG. 15*c* shows a narrow view of the pressure nodule of FIG. 15*a;*

Alternatively, FIGS. 15*a–c* show another embodiment of the pressure nodule 915. FIG. 15*a* shows a rectangular horizontal cross section 1300 of the pressure nodule 915 having a length 1310 of approximately 0.2" to 1", and a width 1315 of approximately 0.25" to 0.5". FIG. 15*b* shows a broad side view of the pressure nodule 915 while FIG. 15*c* shows a narrow side view. FIGS. 15*b–c* show the flat upper surface 1335 of the pressure nodule 915.

Figure 15D:
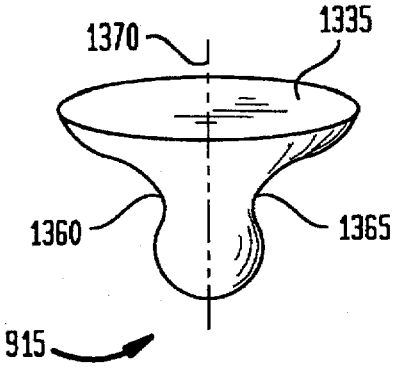
FIG. 15*d* shows a narrow view of a symmetric pressure nodule.

The wide and narrow surfaces, having the lengths 1310, 1315 respectively, curve slightly in their vertical dimension. As shown in FIG. 15*c*, one side 1340 of the wider surface, (having the lengths 1310), of pressure nodule 915 is curved more than the other side 1345. This gives the pressure nodule 915 the shape of a slightly curled tongue. However, to simplify production, the sides of the wider surface, having the length 1310, may be symmetrical. FIG 15*d* shows the pressure nodule 915 where both sides 1360, 1365 of the wider surface, (having the length 1310 shown in FIG. 15*a–b*), have symmetric curved shapes. Thus, the vertical cross section of the pressure nodule 915, shown in FIG. 15*d*, is symmetrical about a vertical axis 1370 which is perpendicular to the flat upper surface 1335.

The larger horizontal side 1310 (FIG. 15*a*) of the pressure nodule 915 allows more forgiveness in its placement on the LI-4 acupressure point. This makes the acupressure device more user friendly, as the need for exact and precise placement of the pressure nodule 915 on the LI-4 acupressure point is reduced.

The vertical curve of the pressure nodule 915 allows it to fit snugly against the tissues overlying the bone of the forefinger 939. This brings the pressure nodule 915 into more intimate contact with the LI-4 acupressure point as it is pulled sideways and pushed downwards by the elastic band 910.

The vertical depth or height 1350 of the pressure nodule 915 is approximately 0.2" to 1" This vertical height 1350 allows the pressure nodule 915 to be pressed down against the LI-4 acupressure point with greater force than would be created if it were shorter. Thus, pressure nodules 915 having different sizes and shapes may be used to achieve a desired pressure on the LI-4 acupressure point. In addition, pressure nodules 915 having different softness may be used. For example, a small and soft pressure nodule 915 may be used for extended periods of time such as during driving or golfing. Such small and soft pressure nodule 915 may also be used during strenuous physical activities, such as weight lifting or activities that requires constant and rigorous use of the hand, such as scrubbing dirt or polishing cars, etc.

The acupressure device 900 is easy to use and apply. Referring to FIG. 9, the hand 905 is inserting into the first opening 925 of the back section 920 of the elastic band 910. The elastic band 910 is pulled back over the hand 905 until the first opening 925 surrounds a wrist 927.

As the elastic band 910 is pulled back over the hand 905, the thumb 937, forefinger 939, middle finger 941 and ring finger 943 are inserted into the second opening 935 of the front section 930 of the elastic band 910. The pinkie 947 is inserted into the slit 945 in the front section 930 of the elastic band 910.

The pressure nodule 915 is positioned over the LI-4 acupressure point. If the pressure nodule 915 is rectangular, than the broad side 1310 (FIG. 15*a*) of the pressure nodule 915 is placed across the thumb bone 985 and the forefinger bone 975. The three forces exerted by the elastic band 910 clamp the pressure nodule 915 on the LI-4 acupressure point. This stimulates the LI-4 acupressure point. Thus, the clamping force generated by the elastic band 910 is transmitted from the elastic band 910 to the LI-4 acupressure point via the pressure nodule 915.

The acupressure devices 1100, 1200, 1400 (FIGS. 12, 13 and 14) are used in a fashion similar to using the acupressure device 900 (FIGS. 9–11). For the acupressure device 1100 (FIG. 12), the thumb is inserted in the thumb hole 1110. For the acupressure device 1200 (FIG. 13), the tension in the U-shaped spring 1205, which is attached to the outer or inner surfaces of the elastic band 910, or imbedded therein, is adjusted to vary the clamping force exerted on the pressure nodule 915. For the acupressure device 1400 (FIG. 14), the straps 1410, 1420 are adjusted, e.g., pulled and attached to the patches 1430, 1440, to vary the clamping forces exerted on the pressure nodule 915.

The amount of pressure necessary to stimulate the LI4 acupressure point is approximately between 4 to 30 ounces. This depends on the size, muscularity of the hand, e.g, whether the hand is that of a child, man or woman. The required amount of pressure also depends on the size and shape on the pressure nodule.

The pressure nodule 915 of the acupressure devices 900, 1200, 1400, shown in FIGS. 9–14, may be removably attached to the elastic band 910. For example, the flat upper surface 1335 (FIGS. 15*b*–15*d*) of the pressure nodule 915 may have a snap that mates with a snap receptor attached to the elastic band 910. This allows the pressure nodule 915 to be snapped on the elastic band 910. To vary the pressure exerted on the LI-4 acupressure point, a pressure nodule attached to the elastic band 910 may be exchanged with another pressure nodule having a different size. This increases the versatility of the acupressure devices 900, 1200, 1400 for use with different size hands and for delivering different amounts of pressure to the LI-4 acupressure point.

Figure 16A:
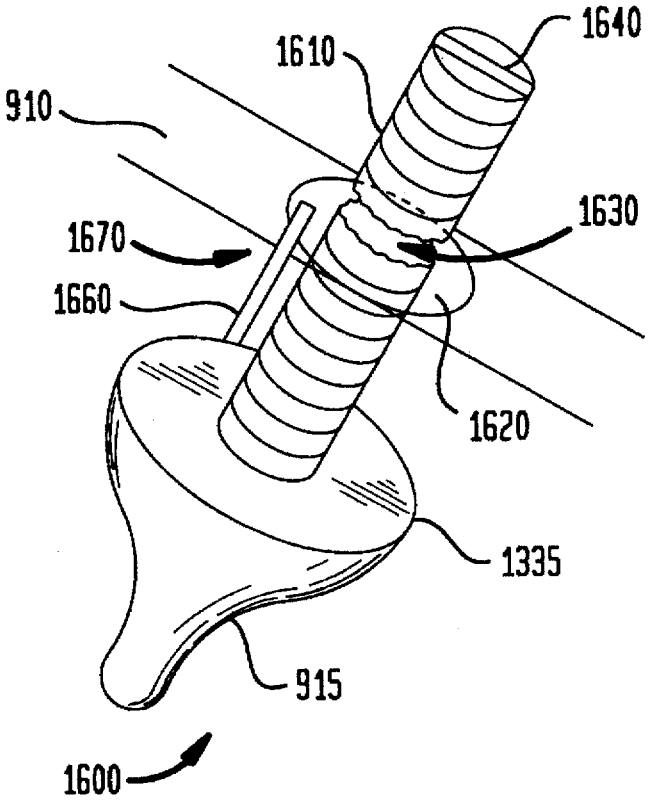
FIG. 16*a* shows an adjustable height pressure nodule.

FIG. 16*a* shows an adjustable height pressure nodule 1600, which may be substituted for the pressure nodule 915 of the acupressure devices 900, 1100, 1200, 1400, shown in FIGS. 9–14. The adjustable height pressure nodule 1600 has a threaded shaft 1610 which is attached to the flat upper surface 1335 of the pressure nodule 915. The elastic band 910 used with the adjustable height pressure nodule 1600 has a ring 1620 with a threaded inner surface 1630. The threaded shaft 1610 is screwed through the threaded inner surface 1630 of the ring 1620.

Figure 16B:
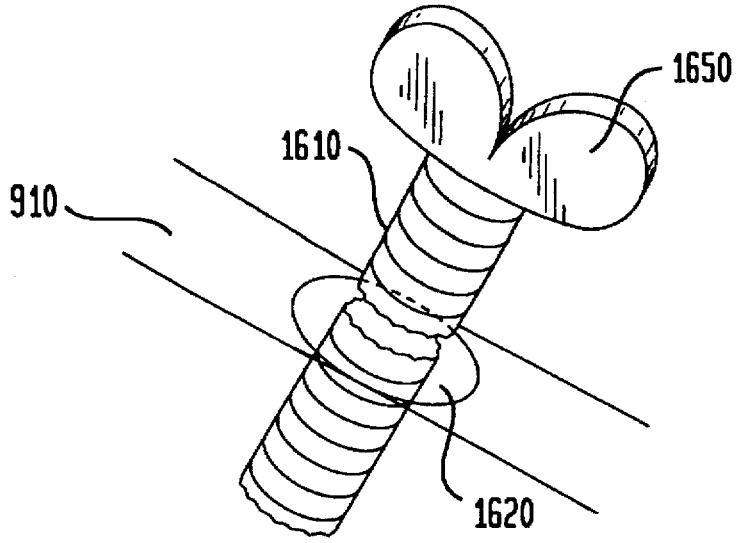
FIG. 16*b* shows the adjustable height pressure nodule of FIG. 16*a* having a wingnut.

The threaded shaft 1610 is turned to adjust the height of the adjustable height pressure nodule 1600. This adjusts the pressure applied to the LI-4 acupressure point. Turning the threaded shaft 1610 in one direction, e.g., clockwise, lowers the pressure nodule 915. This increases the pressure on the LI-4 acupressure point. Turning the threaded shaft 1610 in the other direction, e.g., counterclockwise, raises the pressure nodule 915. This reduces the pressure on the LI-4 acupressure point. To facilitate turning, the top of the threaded shaft 1610 may have a slot 1640 for inserting a coin or a screwdriver. Alternatively, a wingnut 1650, shown in FIG. 16*b*, may by attached to the top of the threaded shaft 1610.

The pressure nodule 915 may be fixedly or swivelly attached to the threaded shaft 1610. For the swivelly attached pressure nodule 915, a pin 1660 is fixedly attached to the flat upper surface 1335 of the pressure nodule 915. The pin 1660 extends through a notch 1670 in the ring 1620. This arrangement prevents the swivelly attached pressure nodule 915 from turning when the threaded shaft 1610 is turned. This prevents skin abrasion when the threaded shaft 1610 is turned to lower the pressure nodule 915 for applying pressure on the LI-4 acupressure point.

In summary, an acupressure device is disclosed which is easy to manufacture and convenient to use. The acupressure device is designed for effective and comfortable use by a wide segment of the population.

Finally, the aforementioned discussion is intended to be merely illustrative. Numerous other embodiments of the present invention may be devised by those having ordinary skill in the art without departing from the spirit or scope of the following claims.

I claim:

1. An acupressure device for stimulating a nerve on a hand having first, second and fifth metacarpals, an outermost carpal, a wrist, a palm, a palm heel, a fleshy crotch, a backhand, and a pinkie, comprising:

an elastic band dimensioned to be worn on the hand, said elastic band comprising:

a first band portion dimensioned to wrap from the first metacarpal around a heel of a palm to the outermost carpal and around a lower portion of a backhand near the wrist back to the first metacarpal, a second band portion dimensioned to wrap from the first metacarpal around the palm to the base of the pinkie and around the backhand back to the first metacarpal, wherein said first and second band portions are integral at a portion of the fleshy crotch of the backhand between the first and second metacarpals and wherein said two band portions are separated from each other by a gap at the fifth metacarpal, and a pressure nodule attached to said elastic band at said integral portion of said two band portions and positioned over the fleshy crotch of the backhand, wherein dimensions of said elastic band produce a tension that forces said pressure nodule downward on said fleshy crotch of said hand, wherein dimensions of said first band portion produce a tension that pulls said pressure nodule towards a part of said first band portion near the outermost carpal and wherein dimensions of said second band portion develop a tension that pulls said pressure nodule towards a part of said second band portion near the base of the pinkie.

2. The acupressure device of claim 1 further comprising a adjustment straps attached to said elastic band to vary said downward force.

3. The acupressure device of claim 1 wherein said elastic band is a glove.

4. The acupressure device of claim 1 wherein the second portion has a pinkie hole into which the pinkie is inserted.

5. The acupressure device of claim 4 wherein the second portion has a thumb hole into which the thumb is inserted.

6. The acupressure device of claim 1 wherein said pressure nodule has a flat side, a longitudinal portion, which extends from said flat side and which terminates at a blunt nosed projection that is configured to contact the fleshy crotch of the hand, said longitudinal portion extending along a curved path relative to a normal direction of said flat side so that said pressure nodule has a symmetrical shape.

7. The acupressure device of claim 1 further comprising a U-shaped spring attached to said elastic band, said U-shaped spring having one end contacting said flat side of said pressure nodule and another end located on a palmar side of said hand, wherein a tension of said U-shaped spring is adjustable.

8. A method for exerting pressure toward a point on a back edge of a hand opposite a thumb of said hand between a wrist and a pinkie of said hand and exerting pressure toward a base of said pinkie of said hand comprising:

positioning a first band portion of an elastic band on the hand so that said first band portion wraps from the first metacarpal around a heel of a palm to the outermost carpal and around a lower portion of a backhand near the wrist back to the first metacarpal, positioning a second band portion of said elastic band on the hand so that said second band portion wraps from the first metacarpal around the palm to the base of the pinkie and around the backhand back to the first metacarpal, wherein said first and second band portions are separated from each other by a gap at the fifth metacarpal, positioning a pressure nodule, that is attached to said first and second band portions, so that a blunt nosed projection of said pressure nodule touches a fleshy crotch of the hand;

using said first band portion to exert a first lateral force which pulls said pressure nodule toward a point on a back edge of the hand opposite the thumb of the hand between the wrist and the pinkie of the hand; and using said second band portion to exert a second lateral force which pulls said pressure nodule toward a base of the pinkie of the hand.

9. The method for exerting pressure of claim 8 further comprising:

using said elastic band to exert a third downward force which pulls said pressure nodule towards the fleshy crotch of the hand.

10. An acupressure device for stimulating the LI-4 pressure point of the hand comprising:

an elastic band dimensioned to be worn on a hand having a ring located within said elastic band and positioned over on LI-4 acupressure point, said ring having a threaded linear surface, a pressure nodule having a flat side and a blunt-nosed projection, said blunt nosed projection configured to contact the LI-4 acupressure point, a threaded shaft attached to said flat side of said pressure nodule and screwed through the threaded inner surface of said ring, wherein said pressure nodule is swivelly attached to said threaded shaft and further comprising a pin fixedly attached to said flat side of said pressure nodule, and wherein said ring has a notch configured to receive said pin to prevent said swivelly attached pressure nodule from turning when said threaded shaft is turned, and said elastic band exerts a downward force on said pressure nodule.

* * * * *